United States Patent [19]

Kamegaya et al.

[11] 3,952,221

[45] Apr. 20, 1976

[54] GASEOUS DISCHARGE DISPLAY PANEL INCLUDING AN APERTURED, ELECTRICALLY INSULATING, DISPLAY SHEET WITH ELECTRODES

[75] Inventors: Takeo Kamegaya, Tokyo; Ryuichi Kaneko, Kawasaki; Minori Yokozawa, Taira; Hideomi Matsuzaki, Nara, all of Japan

[73] Assignee: Nippon Hoso Kyokai, Tokyo, Japan

[22] Filed: July 25, 1974

[21] Appl. No.: 491,634

[30] Foreign Application Priority Data

July 28, 1973 Japan ..... 48-84571

[52] U.S. Cl. ..... 313/188; 313/209; 313/217; 313/220; 313/485; 313/491; 313/493

[51] Int. Cl.[2] ..... H01J 61/067; H01J 61/09; H01J 61/30; H01J 61/48

[58] Field of Search ..... 313/188, 217, 491, 493, 313/220, 209, 210, 484, 485; 315/169 RV

[56] References Cited

UNITED STATES PATENTS

| | | | |
|---|---|---|---|
| 3,626,235 | 12/1971 | Kupsky | 313/217 X |
| 3,631,530 | 12/1971 | Ogle | 313/220 |
| 3,743,879 | 7/1973 | Kupsky | 313/484 |

*Primary Examiner*—Palmer C. Demeo
*Attorney, Agent, or Firm*—Stevens, Davis, Miller & Mosher

[57] ABSTRACT

A gaseous discharge display panel in which in order to display images of good quality with high brightness and high efficiency a discharge unit constituting of a picture element of the display panel is formed as an elongated fine section extending in parallel to the display plane and discharge is produced in the longitudinal direction of the discharge unit so as to display images with the aid of plane discharge. Particularly in order to display color images on the front and/or rear side of the discharge unit there is arranged an insulating sheet to which fluorescent materials are applied in such a manner that the fluorescent materials are opposed near a discharge plasma with a large area and an ultra-violet ray produced by the discharge can excite efficiently the fluorescent materials. The display panel is so constructed that luminescent light from the fluorescent materials having a large surface area can be inspected in the form of the reflected and transmitted light so as to increase the luminous brightness by several times compared with known display panels. Moreover, a cathode of the discharge unit is arranged at a position hidden from the fluorescent materials so as to prevent sputtered cathode materials due to ion bombardment from being applied to the fluorescent materials, so that the fluorescent materials are not blackened and thus the luminous brightness is not decreased.

21 Claims, 37 Drawing Figures

GASEOUS DISCHARGE DISPLAY PANEL INCLUDING AN APERTURED, ELECTRICALLY INSULATING, DISPLAY SHEET WITH ELECTRODES

BACKGROUND OF THE INVENTION

1. Field of the Invention

This invention relates to a display panel for displaying images by utilizing gaseous discharge and more particularly a gaseous discharge display panel for displaying color images.

2. Description of the Prior Art

Nowadays several kinds of gaseous discharge display apparatuses have been developed for output devices of electronic computers. Some of them have been practically used. Recently active studies have been conducted in various fields for developing a new display apparatus for television images. However known display apparatuses have many disadvantages and thus they could not be used as the television image display apparatus. These disadvantages are mainly concerned with an operational characteristic of a discharge unit and luminous characteristics, particularly brightness and luminous efficiencies in case of displaying color images. The former problem is mainly due to a fact that an operational voltage of the discharge units is high and the response speed of the discharge hardly corresponds with a scanning speed of the television standards. This problem can be solved by transferring glow discharge at a rear side of the display part by using the same principle as that used in a dekatron so as to realize a line-simultaneous address device such as a known self-scan panel display device (SSPD). In order to avoid the latter problem great effort has been made. For example in order to improve the brightness and luminous efficiencies, fluorescent materials are provided in the discharge unit and are excited by an ultra-violet ray. However, this latter problem could not be satisfactorily avoided. In particular the low brightness and low efficiency are serious drawbacks in the case of displaying color images even in the above mentioned self-scan panel display device. Therefore it has been earnestly required to obviate the latter drawbacks.

It has been proposed to form the gaseous discharge display panel by a plurality of layers, at one of which is produced an addressing or scanning glow discharge array and wherein another one of which is used for display discharge, and display discharge units at which said glow discharge array are situated are made to discharge more easily than another other display discharge units so as to address positively the particular display discharge unit. In one example of such a gaseous discharge display panel of multi-layer construction each cathode for forming the scanning glow discharge array is made of a strip-shape electrode in which a number of holes are formed at a given interval. A number of such cathodes are arranged in parallel with each other adjacent to an intermediate sheet of an insulating plate in which a number of through holes are formed in a matrix form, these holes being aligned with the small holes in the cathodes. On the rear side of the cathodes are arranged a number of scanning anodes, each of which is formed by a straight wire and is inserted in a trough formed on an inner surface of an insulating rear sheet. These scanning anode wires are arranged in parallel with each other and at right angles with respect to the extending direction of the cathodes. The scanning anode wires are aligned with the small holes of the cathodes and are spaced from the cathodes by a given distance. On the display side of the intermediate sheet are arranged a number of display anodes, each consisting of a straight wire aligned with the small holes of the intermediate sheet. These display anodes are arranged in parallel with each other and at right angles with respect to the extending direction of the strip-shape cathodes. The scanning cathodes also serve as display cathodes which cooperate with the display anodes. On the front side of the display anodes is arranged a front sheet. These sheets are stacked and the peripheries of the assembly are hermetically sealed by means of flits. Inside of the assembly is introduced a gas mainly consisting of neon. In the case of displaying color images by using the above mentioned known display panel, red, blue and green fluorescent materials are applied to an inner surface of each hole formed in the intermediate sheet or fluorescent materials are applied to the inner surface of the front sheet at positions corresponding to the holes of the intermediate sheet. In this case a mixed gas of neon and xenon is used and fluorescent materials are excited by ultra-violet rays produced by gaseous discharge. When a color image is displayed by means of the known gaseous discharge display panel of the above construction, the following drawbacks arise.

1. Since the electric field of a positive column produced at the through hole of the intermediate sheet is week, the intensity of the produced ultra-violet ray is small. The fluorescent materials are mainly exited by the ultra-violet ray from the negative glow formed at the front surface of the cathode and the ultra-violet ray is absorbed by the introduced gas on account of the positions of the fluorescent materials, so that the luminous intensity is low.

2. Due to the construction of the discharge unit the luminescence from the fluorescent material is inspected as a transmitted light or in case of viewing the reflected light only a part thereof is inspected and thus the brightness of displayed images is low.

3. Owing to the construction of the cathodes it is impossible to supply a large discharge current in the normal glow discharge condition, so that the high brightness cannot be obtained even by exciting the fluorescent materials by the ultra-violet ray produced from the discharge. If the larger current than the normal glow discharge is supplied, the chromaticity of the fluorescent materials is extremely deteriorated.

4. Since the discharge units each forming a picture element or dot cannot be arranged with a high density, the good image of high quality could not be displayed.

5. Since it is difficult to connect the discharge units, a large screen display apparatus cannot be easily obtained by composing a plurality of display panels.

6. Since the light of the scanning discharge moving at the rear side of the panel penetrates into the display side, the brightness of a background of images becomes higher and thus the contrast range of the images is made narrow.

SUMMARY OF THE INVENTION

It is an object of the invention to provide a novel gaseous discharge display panel which can avoid the above mentioned disadvantages of the known devices by introducing a novel construction for the discharge unit and the display panel in such a manner that the electric field of the positive column can be made higher, the cathode can be operated in a hollow cathode discharge condition so as to decrease the cathode drop, the normal glow discharge can be maintained even at a larger discharge current and the radiation intensity of the ultra-violet ray can be increased.

It is another object of the invention to provide a gaseous discharge display panel in which the luminescent light from the fluorescent materials can be inspected both as the transmitted and reflected light and the absorption of the ultra-viloet ray in the introduced gas can be decreased to a great extent.

It is still another object of the invention to provide a gaseous discharge panel in which the discharge unit is so constructed that the high density of the picture elements can be attained so as to improve the quality of the displayed image, and thus a plurality of discharge units can be composed to form a large screen panel display apparatus and further the contrast range can be made wider by improving the way of arranging and driving the electrode lead wires.

DESCRIPTION OF THE PREFERRED EMBODIMENTS

Figure 1A:
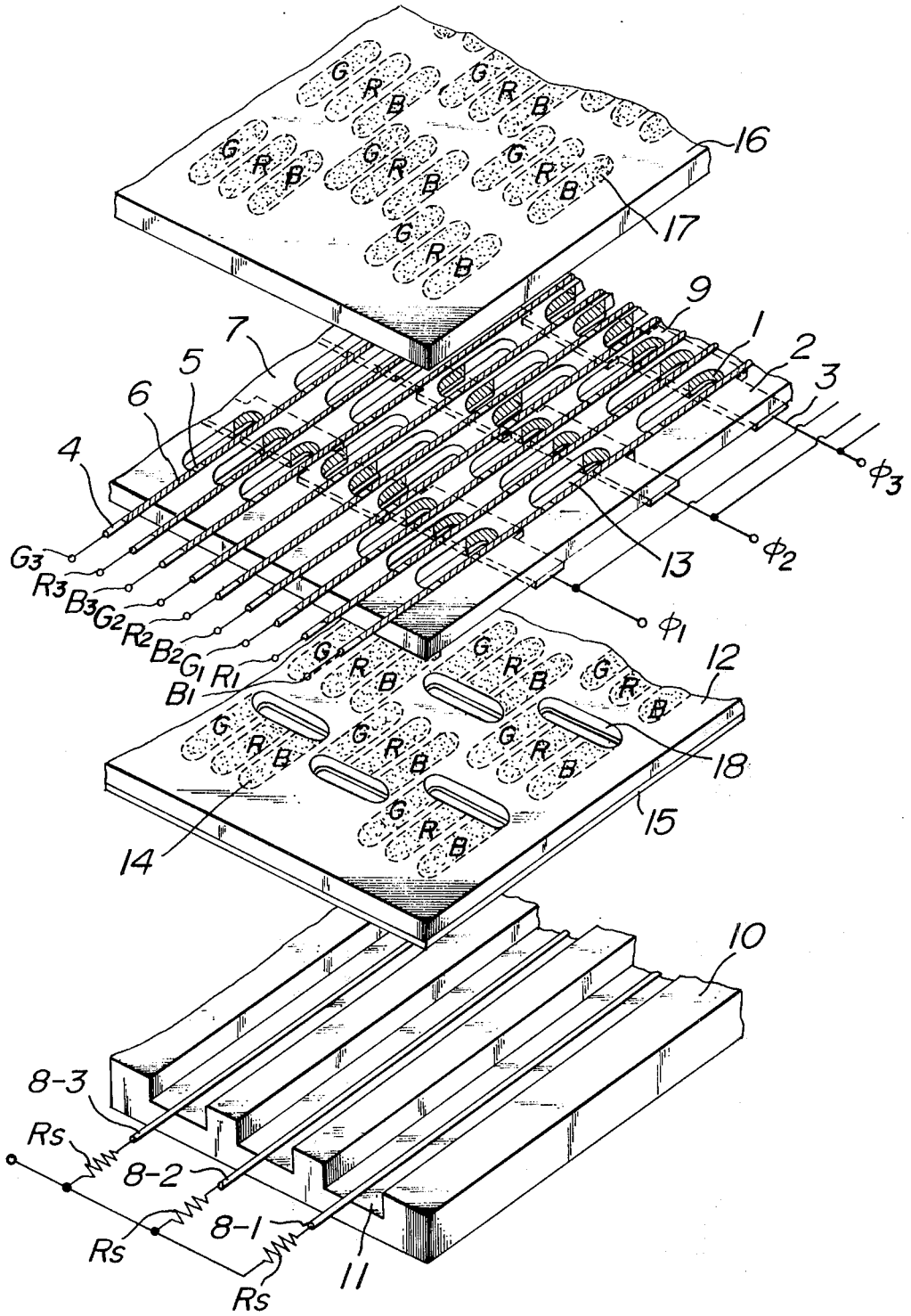
FIGS. 1(*a*) and 1(*b*) are an exploded perspective view and a cross sectional view, respectively, of an embodiment of the gaseous discharge display panel according to the invention, and FIG. 1(*c*) is a plan view showing a portion of the panel in the expanded scale.
Figure 1B:
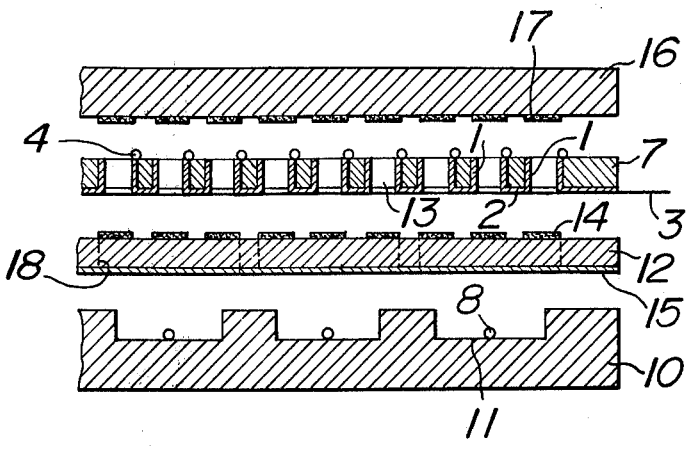
Figure 1C:
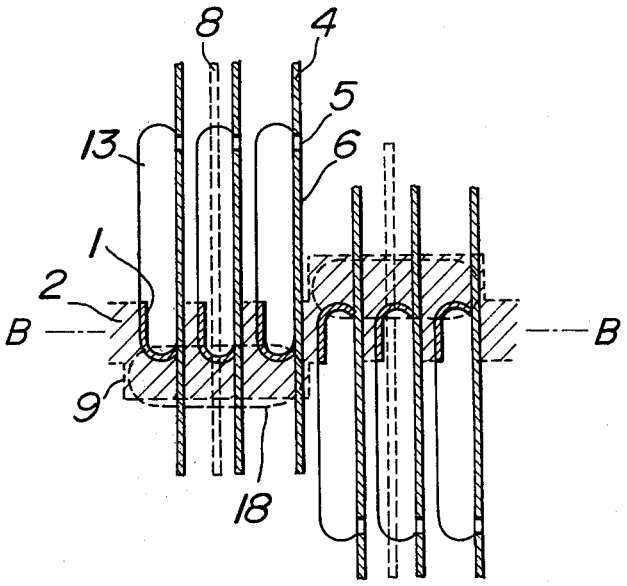

FIGS. 1(*a*), 1(*b*) and 1(*c*) are an exploded perspective view, a cross sectional view and an enlarged plan view, respectively, of an embodiment of a gaseous discharge display panel according to the invention. As shown in the drawings there are formed a number of elongated small through holes 13 in a transparent or opaque electrically insulating plate 7. These holes 13 are arranged in parallel with each other. On an inner surface of one end viewed in the longitudinal direction of each hole 13 is applied conductive material so as to form a U-shaped cathode 1. The adjacent cathodes are electrically connected to each other by means of a specially formed cathode coupling conductor 2. This conductor 2 may be formed by vapor-depositing a metal on a rear surface of the plate 7. An end of this conductor 2 is joined to a cathode leading wire 3. On the front surface of the plate 7 there are arranged wire-like front anodes 4 along the longitudinal direction of the through holes 13. The wire-like front anodes 4 are covered with thin films 6 of insulating material such as glass except for operational portions 5 which situate at ends of the elongated holes 13 opposite to that end which is applied with the cathode 1. Since the display function is effected by the discharge radiation produced by the discharge current passing into the operational portion 5 of the anode 4, this is termed as a display anode. The insulating plate 7 may be formed by a glass or ceramic thin plate and is called a display insulating plate or display sheet. There are further provided rear anodes 8 in the form of straight wires inserted in troughs 11 formed on an inner surface of a rear sheet 10 made by opaque insulating material such as opaque glass or ceramic. The rear anodes 8 have a function to transfer the discharge formed between the anodes 8 and cathode coupling conductor portions 9 formed by parts of the cathode coupling conductors 2 and thus they are termed as scanning anodes. Between the display sheet 7 and the rear sheet 10 is arranged an intermediate sheet 12 of insulating material such as glass or ceramic. In this intermediate sheet 12 there are formed a number of elongated through holes 18. The longitudinal direction of these through holes 18 is at right angles to that of the holes 13 formed in the display sheet 7. Each hole 18 is formed at such a position that parts of the cathodes 1 of each group consisting of three successive discharge units can be seen through the hole 18 from the rear anode side and that a scanning discharge space can be formed between the scanning anodes 8 and the cathode coupling conductor portion 9 serving as scanning cathodes for the cathodes 1 (hereinafter referred as scanning cathode portions).

On the front surface of the intermediate sheet 12 are applied red, green and blue fluorescent materials 14 at positions corresponding to the through holes 13. On the rear surface of the intermediate sheet 12 is applied an opaque insulating layer 15 such as colored glass so as to prevent the light due to the discharge around the rear anodes 8 from penetrating into the display side. On the front side of the intermediate sheet 7 is arranged a front sheet 16 made of transparent insulating material, for example, glass. On an inner surface of the front sheet 16 are applied red, green and blue fluorescent materials 17 at positions corresponding to the fluorescent materials 14 applied to the intermediate sheet 12. The rear sheet 10 and front sheet 16 constitute a part of a housing having a function of a hermetically sealing body. Within this housing is introduced a single or mixed gas selected from a group consisting of neon, helium, argon, krypton, xenon, hydrogen, nitrogen and mercury vapor.

In the foregoing the whole construction of the embodiment according to the invention has been described and now the detailed construction and arrangement thereof will be explained. In the gaseous discharge display panel according to the invention each discharge unit constituting a picture element is formed in the thin and flat insulating sheet 7 as the elongated hole 13 in parallel with the display surface. The inner surface of the elongated hole is covered at its one end with conductive material so as to form a U, V or rectangular shaped cathode 1. In the discharge condition the inner surface having a large area serves to be the cathode discharge and thus the cathode 1 is operated as the hollow cathode in which the voltage drop across the cathode is small and a large discharge current can flow stably. In the case of displaying the color image by the gaseous discharge display panel of the present embodiment each group consisting of three successive discharge units constitutes a picture element. A great number of picture elements are arranged in a zigzag manner so as to display color images in an interlaced mode. In this case the cathodes 1 of the discharge units are connected to each other by applying conductive material on the rear surface of the display sheet 7. The manner of connecting the discharge units is shown in the drawings. That is successive three cathodes 1 are coupled into a single group and successive groups are displayed alternately and thus a number of groups are coupled to each other by means of a straight strip-like conductor 2 so as to decrease the number of lead wires 3. The cathodes coupling conductors 2 extend at right angles to the longitudinal direction of the elongated holes 13. If the interlace scanning need not be effected, a number of discharge units may be arranged in the form of a grid instead of the zigzag form.

In the present embodiment the wire-like display anodes 4 are arranged along the longitudinal direction of the elongated through holes 13 at the peripheries of these holes. The conductive portion 5 of the wire 4 which is not covered with the insulating material 6 such as glass and is situated at an end opposite to the cathode 1 serves as the display anode so as to produce the discharge between the anode 5 and cathode 1 in parallel with the display surface. The display anode may be formed by a conductive strip applied on the front surface of the sheet 7 near the peripheries of the holes 13. Further an end of the elongated through holes 13 opposite to the cathodes 1 may be slightly curved in a hook shape and the conductive portion of the display anode wire 4 may be exposed at the tip of the hook so that the display anode wire 4 can be easily provided. The display anode system may also be formed by conductive strips deposited on the rear surface of the front sheet 16, in which the conductive strips deposited beside the fluorescent materials 17 are covered with insulating material and exposed conductive portions not covered with insulating material and electrically connected to the conductive strips are extended from the conductive strips of such positions that tips of the conductive portions are situated at the middle of one end of the elongated holes 13 in case of stacking the sheets.

As described above in the case of displaying a color image by means of the gaseous discharge display panel it has been known to utilize the ultra-violet ray produced by the discharge in order to excite the fluorescent materials. Various attempts have been made for realizing the above known method, but none of them succeeded owing to the low brightness. This is due to the fact that owing to the improper construction the intensity of the ultra-violet ray produced from the plasma formed by the discharge is weak, a distance between the plasma forming part and the fluorescent materials is very long so that the ultra-violet ray is considerably attenuated by the sealed gas before reaching the fluorescent materials, the applied area of the fluorescent materials and the surface area of the plasma in contact with the fluorescent materials are small, and thus the luminous intensity is totally small.

According to the invention in order to obviate the above disadvantages the fluorescent materials are applied both to the inner surface of the front sheet 16 arranged in front of the display sheet 7 and to the front surface of the intermediate sheet 12 arranged behind the display sheet 7, so that the plasma forming portion of the discharge and the fluorescent materials are close to each other to decrease the attenuation of the ultra-violet ray, the fluorescent materials and the plasma can be opposed to each other with a large area, and the luminuous light can be inspected both as the reflected and transmitted light so as to obtain the displayed color image of the high brightness.

Moreover, according to the invention in the intermediate sheet 12 are formed a number of elongated through holes 18 at such positions that the cathodes 1 of the discharge unit group can be seen through the hole 18 and thus the plasma of the scanning discharge formed between the scanning anode 8 arranged behind the intermediate sheet 12 and the scanning cathode portion 9 of the cathode coupling conductor 2 can be easily diffused or moved into the display side so as to obtain the low voltage discharge and high speed operation of the discharge unit constituting the picture element.

Figure 2:
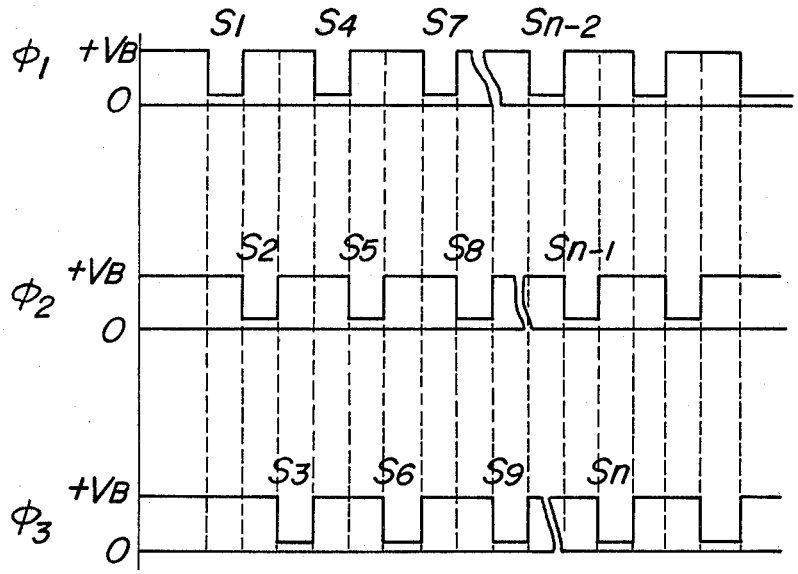
FIG. 2 shows waveforms of the driving voltages of the gaseous discharge display panel of FIG. 1.

The glow discharge formed between the scanning anode 8 and the scanning cathode portion 9 is selectively scanned or moved by means of a three-phase clock signal of square wave as shown in FIG. 2 and at the transferred position the discharge-luminescence is formed between the display cathode 1 and the display anode 4 with the aid of the glow discharge to display the image. Such a driving method has been adopted in the known self-scan panel display device (S.S.P.D.), but in the known display panel the discharge plasma formed in the discharge unit at the display side extends in the direction normal to the display surface and thus the construction and operation of the known display panel are considerably different from those of the display panel according to the invention. That is to say in the display panel according to the invention the three-layer electrode groups, i.e. the rear anode group 8, the cathode and cathode coupling conductor groups 1 and 2 and the front anode group 4 are arranged in the gas atmosphere in the electrically insulated manner and when a voltage difference which can start the discharge is applied to a given cathode and anode, the discharge can be easily produced locally at the crossing points of these electrodes. Due to this fact it is possible to attain easily the basic operation of the image display, that is a given display can be positioned quickly in response to the operation by means of addressing or scanning the plasma. Moreover, if the discharge voltage or current at the display anode is modulated by the image signal, the luminous intensity of successively selected discharge units varies in accordance with the image signal to change the brightness at that position of the image. Therefore, when the addressing or scanning and the corresponding brightness variation are repeatedly effected over the whole panel surface, the two-dimensional display of image is repeatedly carried out.

In the embodiment shown in FIG. 1, to each wire electrode 8-1, 8-2, 8-3, ... of the scanning anode group 8 is applied a d.c. anode voltage of, for example, positive 250 V through respective stabilizing resistors Rs and the cathode lead wires 3 coupled to the cathode group are connected to a pulse generator (not shown) which produces a pulse series of square waveforms as shown in FIG. 2. Therefore during the scanning period the pulse voltage is applied across at least one pair of the scanning anode and cathode. In practice N-phase pulses may be applied simultaneously to every N electrodes or successive pulses of a pulse series occurring substantially at the pulse interval may be applied to the successive cathode lead wires 3. In FIG. 1(*a*) $\phi_1$, $\phi_2$ and $\phi_3$ illustrate a phase sequence of the pulse voltages applied to the cathode lead wires 3. Further in order to flyback the scanning point in the plane scanning from an end position to a start position for a next plane scanning after one plane scanning has been completed, a reset cathode is provided at one end of each cathode coupling conductor 2, to which is voltage pulse is applied. Such known scanning and driving methods could be applied to the display panel according to the invention.

In order to drive the discharge units at the display side, use is made of plasma due to the glow discharge on the scanning side at the transferred position. In the above embodiment the display anodes $R_1$, $R_2$ ... $R_n$; $G_1$, $G_2$ ... $G_n$ and $B_1$, $B_2$ ... $B_n$ for displaying red (R), green (G) and blue (B) colors, respectively, are driven by the display anode driving amplifiers (not shown) and the red, green and blue fluorescent materials are excited by means of ultra-violet rays produced by discharge so as to display the color image. When a television color image is to be displayed by the display panel of the present embodiment, the display anodes are driven in parallel with each other so that all picture elements of one scanning line are simultaneously radiated for a given time period.

When the presently used standard television signals are supplied as the input modulating signals, two memories each having the same capacity as the number of the display anodes are used. At first the input signal is sampled and samplings are successively stored in the first memory. For example, the red, green and blue signals can be derived from the input signals with the aid of a color demodulating circuit and these color signals are sampled independently from each other and the samplings are stored serially in the first memory. In this case one horizontal scanning period or a portion thereof to be displayed is divided into the same number as the number of sets of the R, G and B display anodes.

Next in synchronism with the switching of the cathodes the content of the first memory is simultaneously transferred to the second memory. The content stored in the second memory represents the light amounts which should be radiated from the discharge units until the next transferring instance, so that each memory element drives each display anode through converting and driving circuits. The converting circuit is to convert the picture information stored in the second memory into a brightness modulating signal suitable for driving the display panel. For example if the information is stored in the memory as voltage values and the brightness modulation of the discharge units is effected by controlling the discharge current, the converting circuit may be constructed by a voltage-current converting circuit. If the memory is of a digital memory in which the information is stored as PCM signals, the converting circuit may be a preset counter. Further if the memory stored is the voltage information and the driving circuit is a brightness modulator of a PWM system, the converting circuit may consist of a comparison circuit for comparing the voltage stored in the memory with a sawtooth wave signal which is synchronized with the memory transferring period or of a voltage controlled monostable multivibrator. The known technique can be applied to the converting circuit and thus the detailed explanation thereof is omitted.

In the above explanation the interlace scanning is not considered. In order to display the image with interlace scanning, the discharge unit group arranged in a zigzag manner on both sides of the same cathode coupling conductor 2 is divided into upper and lower arrays and the discharge units of the upper arrays are irradiated only in even fields and the discharge units of the lower arrays are operated only in odd fields. Therefore the driving methods must be somewhat modified. In this case the following three methods are possible.

In the first method in the even fields only the odd numbered display anodes $R_1$, $R_3$, $R_5$. . .; $G_1$, $G_3$, $G_5$...; $B_1$, $B_3$, $B_5$... are energized and in the odd fields only the even numbered display anodes $R_2$, $R_4$...; $G_2$, $G_4$...; $B_2$, $B_4$ ... are driven.

In the second method the scanning anodes 8 are divided into two groups, i.e. an odd numbered group 8-1, 8-3 ... and an even numbered group 8-2, 8-4 ... Each of these scanning anode groups is connected to a scanning anode driving circuit through a common terminal. In the even fields only the odd numbered group is driven and in the odd fields only the even numbered group is energized. Further every successive two display anodes such as $R_1$ and $R_2$, $R_3$ and $R_4$ ...; $G_1$ and $G_2$, $G_3$ and $G_4$ ...; $B_1$ and $B_2$, $B_3$ and $B_4$ ... are connected to each other externally and these paired display anodes are driven by a single display anode driving circuit. In this method the auxiliary discharge for scanning is not produced at the even numbered scanning anode group 8-2, 8-4, 8-6 ... in the even fields so that only the discharge units corresponding to the odd numbered display anodes are excited and in the odd fields only the discharge units corresponding to the even numbered display anodes are energized. In this manner the image can be displayed with the interlaced scanning. When comparing the second method with the first method it is sufficient to provide a half of the number of the memories, converting circuits and display anode driving circuits.

In the third method every two cathode lead wires 3 are divided into a group. That is to say the successive cathode lead wires are divided into $K_{11}$, $K_{12}$; $K_{21}$, $K_{22}$; ... One of the lead wires of each group is commonly connected to the cathodes of the upper discharge units and the other is commonly connected to the cathodes of the lower discharge units. In the first group, every successive three lead wires $K_{11}$, $K_{21}$, $K_{31}$, $K_{41}$ ... are connected in a three-phase mode and in the second group every three lead wires $K_{12}$, $K_{22}$, $K_{32}$, $K_{42}$... are also connected in the three-phase mode. In the even fields only the lead wires of the first group are energized in the three-phase mode and in the odd fields only the lead wires of the second group are energized in the three phase mode to display the image in the interlaced manner. In this case every two anodes such as $R_1$ and $R_2$, $R_3$ and $R_4$ are connected to each other as described in the second method. The above three methods for displaying the interlaced image may be utilized in a combined mode. Further these methods can be applied to another embodiments of the invention which will be explained later.

Now a numerical example of dimensions of the various elements of the gaseous discharge display panel of the present embodiment will be shown.

| | |
|---|---|
| thickness of display sheet 7 | 0.3–0.35 mm |
| length l of hole 13 | 2.0 mm |
| width d of hole 13 | 0.3 mm |
| distance between adjacent holes 13 | 0.1 mm |
| width of discharge unit group | 1.1 mm |
| pitch of adjacent discharge unit groups | 1.2 mm |
| thickness of plate 12 | 0.3–0.35 mm |
| thickness of plate 10 | 4–7 mm |
| width of trough 11 | 0.8–1 mm |
| depth of trough 11 | 0.8–1.5 mm |
| diameter of wire 8 | 0.1–0.2 mm |
| diameter of wire 4 | 30–60 $\mu$ |
| thickness of plate 16 | 3–5 mm |

It has been found that when the length $l$ and width $d$ of the hole 13 in the display sheet 7 satisfy the following condition, the discharge and luminescent properties can be improved $$3d < l < 50d$$

In the embodiment shown in FIG. 1 the front sheet 16 and rear sheet 10 are arranged close to the front and rear sides of the display sheet 7, respectively. If the thickness of the display sheet 7 is too thin, for example, thinner than 0.1–0.15 mm, the discharge voltage might be increased due to the increase of ion loss at the discharge unit. In order to decrease this increase of the discharge voltage, on the front and/or rear side of the display sheet 7 there may be provided an insulating sheet having through holes formed therein at positions corresponding to the through holes 13 in the display sheet 7. Also in this modified construction the condition of the discharge at the discharge units is the same as that which has been explained heretobefore.

After many experiments have been conducted it has been found that in the display panel of the above embodiment since the cathodes 1 are arranged very close to the fluorescent materials, the fluorescent materials are liable to be dissipated due to ion bombardment and also to be blackened by sputtering of the cathodes. In order to avoid such disadvantages, the display sheet 7 may consist of two sheets between which the intermediate sheet 12 having fluorescent materials applied thereon is inserted so that the holes 13 are divided into front and rear halves by the intermediate sheet 2 parallel with the sheet. At one end of the front half of each hole 13 is arranged the display anode 4 and at the other end of the rear half of each hole 13 is provided the cathode 1. In such a construction since discharge plasma formed in the discharge unit is slightly bent in a hook shape at the cathode side parts of the fluorescent materials 17 and 14 near the cathodes 1 are not deteriorated by ion bombardment.

According to another embodiment of the invention, an insulating cathode plate is provided in addition to the insulating display plate, in which display plate a number of elongated through holes are formed in parallel with each other and at one end of the holes are arranged anodes. In said insulating cathode plate there are formed through holes at positions corresponding to the other ends of the holes in the display plate. Cathodes are applied on inner surfaces of the holes in the cathode plate at positions from which the holes in the display plate cannot be seen. The corresponding holes in the display plate and the cathode plate form a display discharge unit.

In the gaseous discharge display panel of such a construction since the cathodes are arranged on the insulating sheet which is different from the display sheet and at positions which are far from the fluorescent materials, cathode sputtering materials due to ion bombardment could not reach the fluorescent materials and thus color images could be obtained with high brightness for long life time and further since discharge light due to the auxiliary discharge at the scanning side behind the cathodes does not penetrate into the display side, the brightness of background of displayed images is considerably decreased so that a contrast ratio of images increases extremely.

Figure 3A:
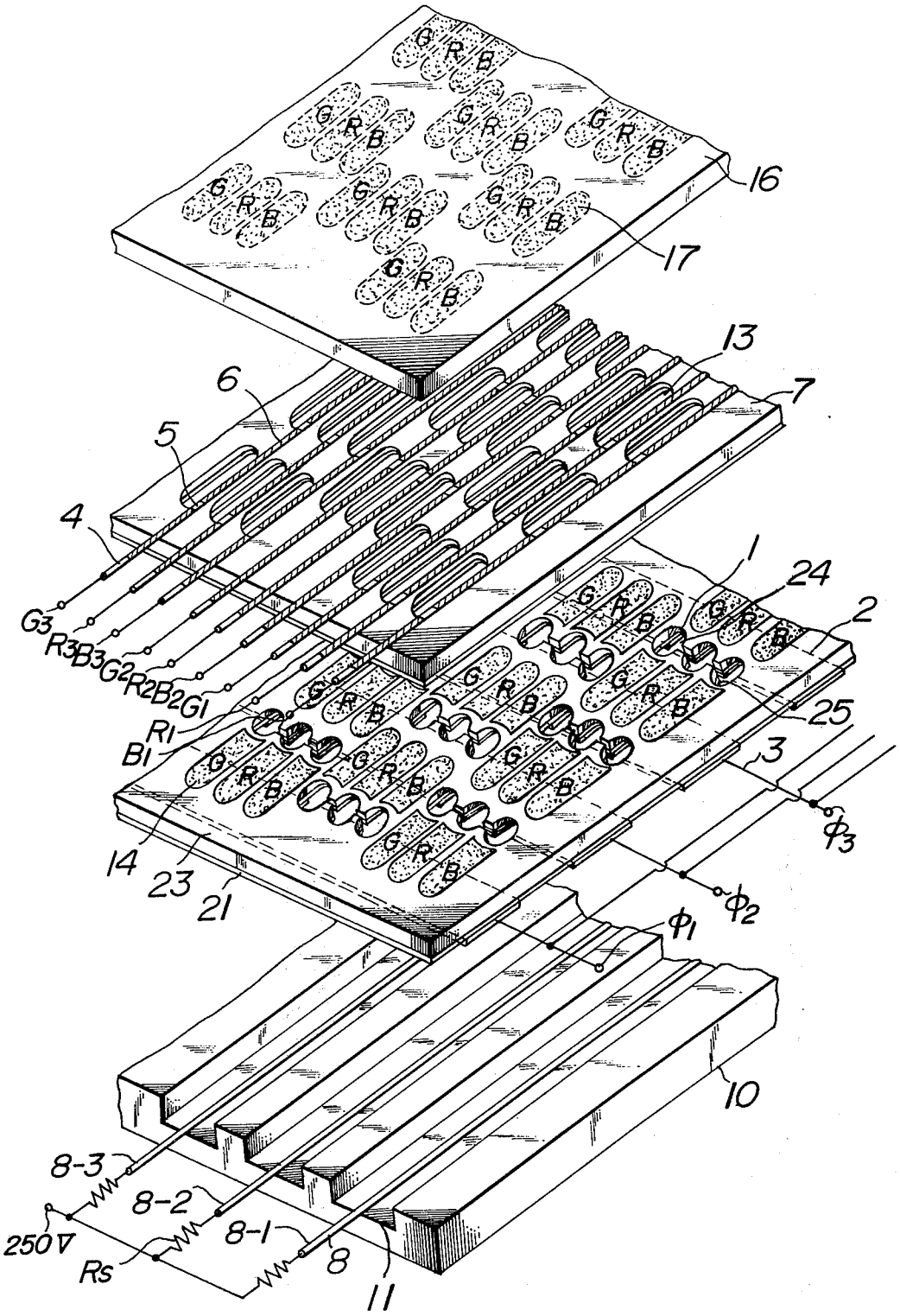
FIGS. 3(*a*), 3(*b*) and 3(*c*) are an exploded perspective view, a cross sectional view and a plan view, respectively, of another embodiment of the present invention.
Figure 3B:
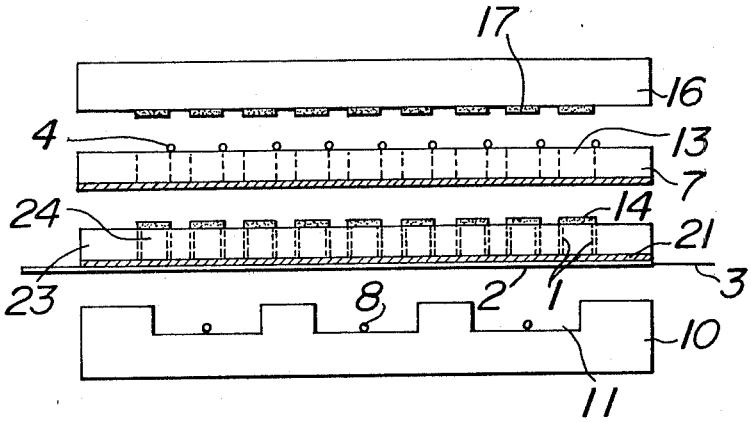
Figure 3C:
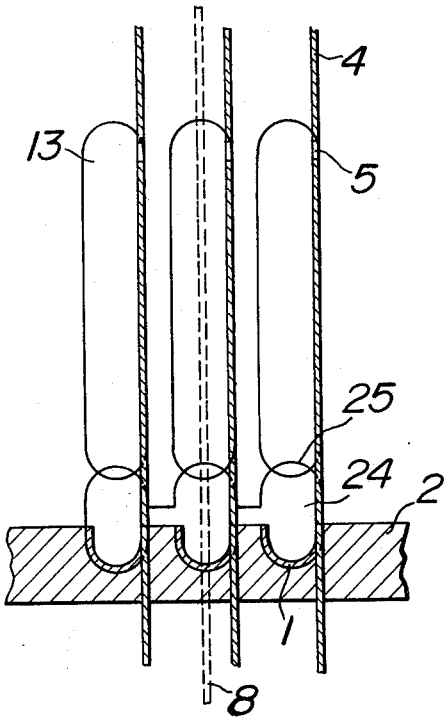

FIGS. 3(*a*), 3(*b*) and 3(*c*) are an exploded perspective view, sectional view and partially enlarged view, respectively, of an embodiment of the gaseous discharge display panel according to the invention, in which the discharge unit is constructed in the above described manner. The display panel of this embodiment also comprises a display sheet 7 of, for example, glass or ceramic. In this display sheet 7 there are formed a number of elongated through holes 13 in parallel with each other. Each hole 13 constitutes a discharge unit together with a display anode 4 and a cathode 1. Behind the display sheet 7 is arranged a cathode sheet 23 comprising a transparent or opaque insulating plate of, for example, glass or ceramic. In the cathode sheet 23 there are formed a number of comb-shaped through holes 24, each of which comprises three elongated holes. As shown in FIG. 3(*c*), the comb-shaped hole 24 corresponds to three successive holes 13 of the display sheet 7. On the inner surface of the comb-shaped hole 24 at a side remote from the discharge unit is applied a conductive material such as nickel to form the cathode 1. The other portion 25 of the hole 24 extruding towards the discharge unit serves as a discharge path for transferring ions and excited atoms from discharge formed between the cathode 1 and the scanning anode 8 and are aligned with a part of the through hole 13. The adjacent cathodes 1 are connected to each other by means of cathode connecting conductors 2 which extend in parallel with each other in the direction normal to the display anodes 4 and each cathode connecting conductor 2 is connected to a cathode lead wire 3. On the display side of the cathode sheet 23 red, green and blue fluorescent materials are applied at positions corresponding to the holes 13 of the discharge units. On the rear side of the cathode sheet 23 there may be applied with an opaque insulating material layer 21 such as a colored glass plate so as to prevent the auxiliary discharge light for scanning formed at the rear side of the cathode plate 23 from penetrating into the display side.

Next the construction and arrangement specified in the present embodiment will be explained in detail. The discharge unit constituting an image element is formed as an elongated section in the display sheet 7 consisting of a thin and flat insulating plate, so that the discharge unit is formed in parallel with the display plane and the comb-shaped through holes 24 each consisting of three holes are formed in the cathode sheet 23 which is made by the thin and flat insulating plate arranged at the rear side of the display sheet 7. Said comb-shaped holes 24 are aligned with the discharge units. On the inner surface of the comb-shaped holes 23 are applied conductive materials at positions remote from the discharge units to form the cathodes 1 which are hidden from the fluorescent materials. In the discharge condition the cathode formed by the conductive materials applied on the inner surface of the holes 24 operate as the hollow cathodes the cathode drop of which is small and which can flow a larger discharge current in a stable manner. Moreover, the fluoresent materials are not deteriorated by materials sputtered from the cathodes.

In the present embodiment the comb-shaped holes 24 are formed at such positions that parts of the holes 24 near the holes 13 of the display sheet 7 are aligned with parts of the holes 13, so that plasma of the auxiliary discharge for scanning formed between the scanning anodes 8 behind the cathode sheet 23 and the cathodes 1 can easily diffuse and move towards the display side so that the discharge unit can attain the low voltage and rapid operational property.

Figure 4A:
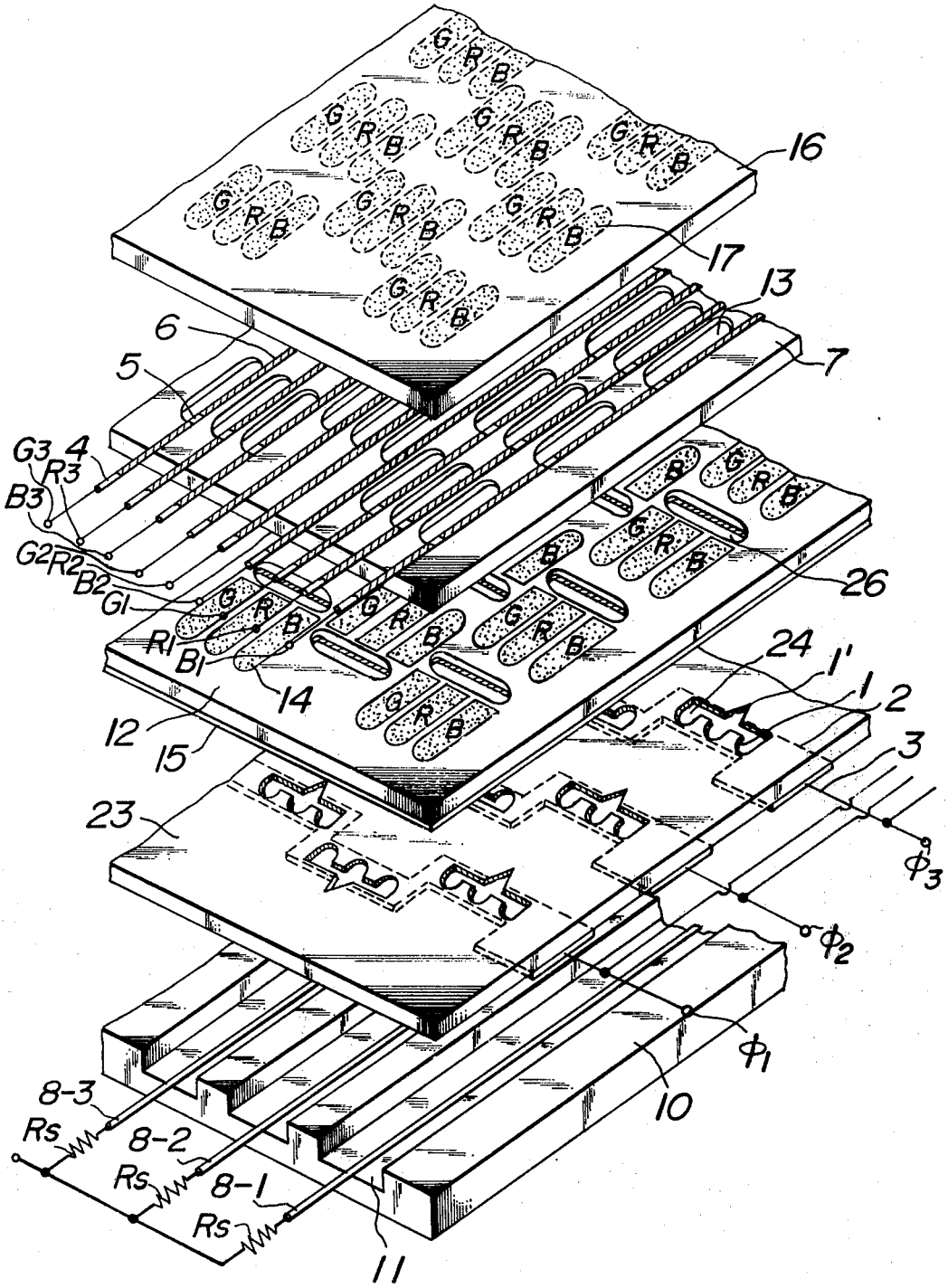
FIGS. 4(*a*), 4(*b*) and 4(*c*) are an exploded perspective view, a cross sectional view and a plan view, respectively of another embodiment of the present invention.
Figure 4B:
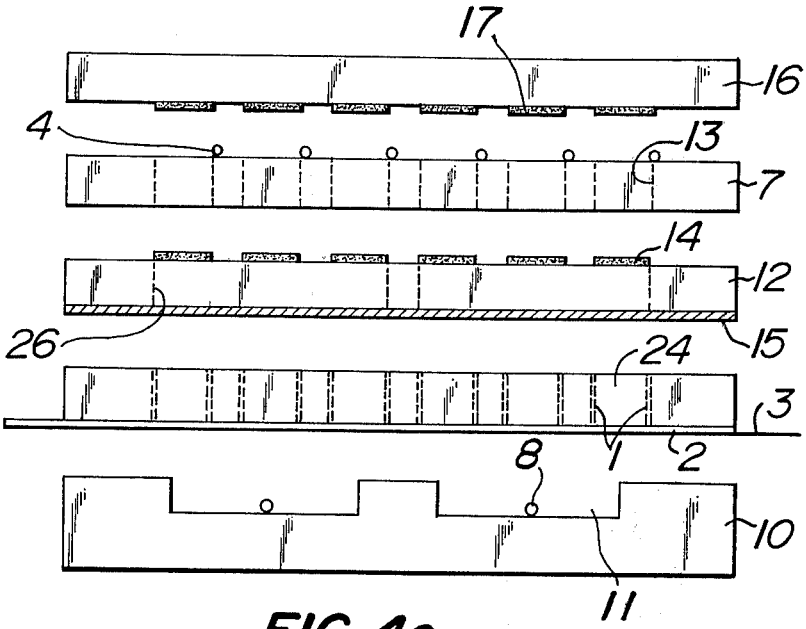
Figure 4C:
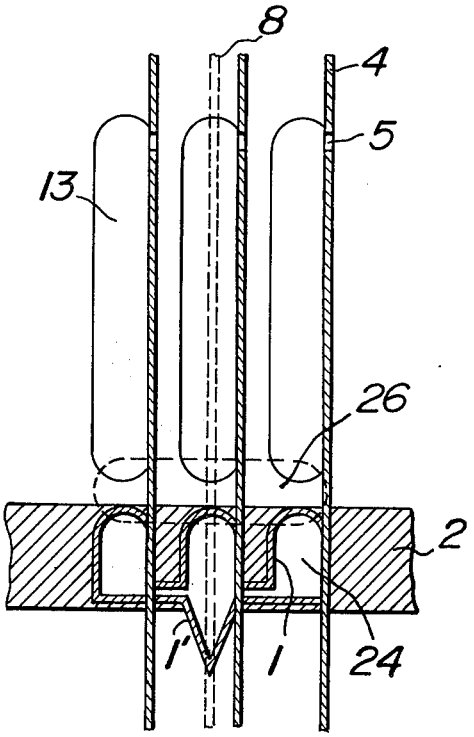

FIGS. 4(*a*), 4(*b*) and 4(*c*) show another embodiment of the gaseous discharge display panel according to the invention similar to the last mentioned embodiment of FIG. 3. In this embodiment comb-shaped through holes 24 in a cathode sheet 23 are formed at such positions that these holes 24 do not align with through holes 13 in a display sheet 7. On an inner surface of each comb-shaped hole 24 is applied a conductive material. A portion of the conductive layer at a side near the discharge unit forms a cathode 1. At the middle of the hole 24 remote from the discharge unit there is provided a wedge-shaped cathode 1' for transferring the auxiliary discharge for scanning. Between the display sheet 7 and cathode sheet 23 is inserted an intermediate sheet 12 of an insulating material such as glass or ceramic, and in said intermediate sheet a number of elongated through holes 26 being formed. The holes 13 in the display sheet 7 and the comb-shaped through holes 24 in the cathode sheet 23 are communicated with each other by means of the through hole 26. In the present embodiment the discharge light due to the auxiliary discharge formed between the transferring cathodes 1' of wedge-shaped and scanning anodes 8 does not substantially appear on the display side. In order to attain this completely, on the rear surface of the intermediate sheet 12 may be applied an opaque insulating layer 15 such as a colored glass plate. The red, green and blue fluorescent materials are applied on the inner surface of a front sheet 16 and on the display side of the intermediate sheet 12 according to a desired pattern.

The other construction and arrangement of the display panel of the present embodiment is the same as those of the previous embodiments except for the above described points and can attain the essentially same operational functions.

Figure 5A:
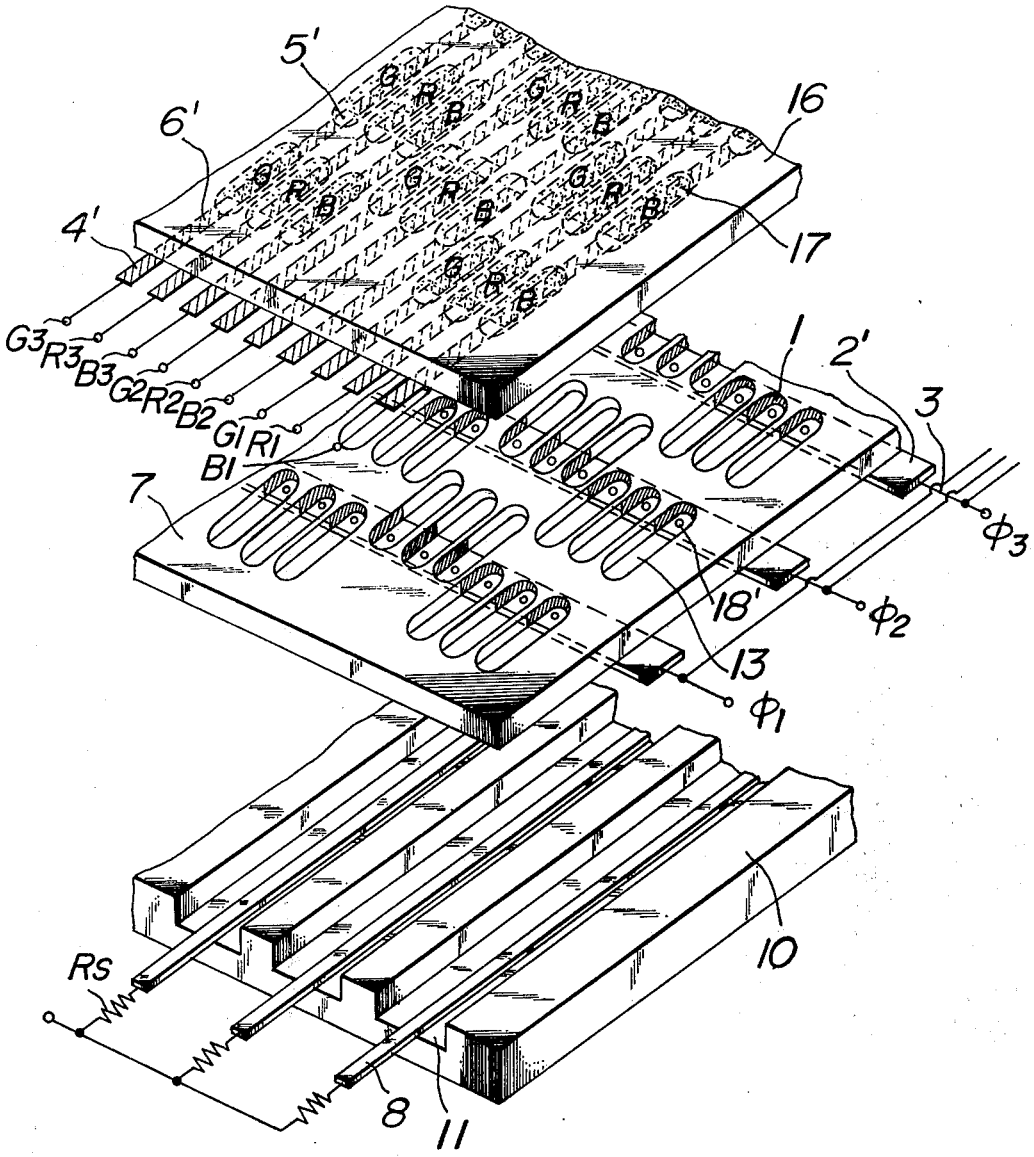
FIGS. 5(*a*), 5(*b*) and 5(*c*) are an exploded perspective view, a cross sectional view and a plan view, respectively, of still another embodiment of the present invention.
Figure 5B:
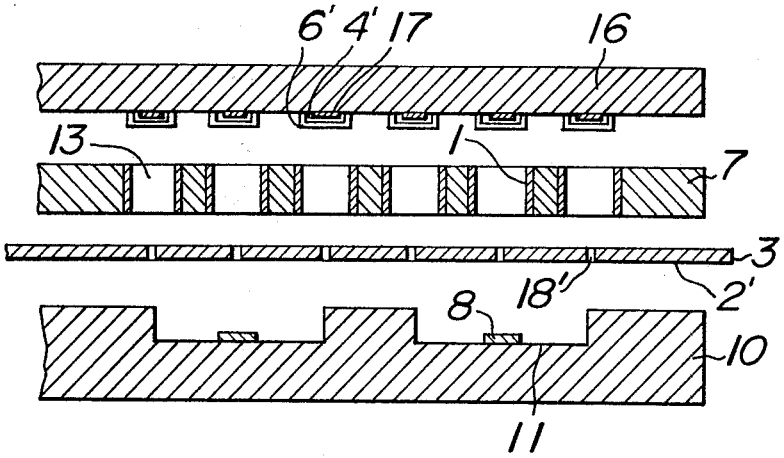
Figure 5C:
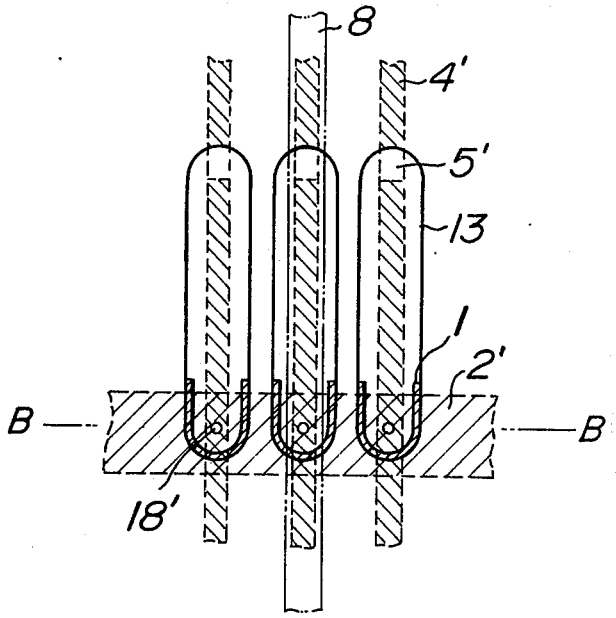

FIG. 5 illustrates still another embodiment of the display panel according to the invention. In this embodiment the intermediate sheet 12 of the first embodiment shown in FIG. 1 is deleted and the cathode coupling conductor 2 is formed by a strip-shaped metal plate 2' instead of the metal deposited film. In the metallic cathode plates 2' there are formed small through holes 18' at positions corresponding to the cathodes 1 of the discharge units so that plasma formed by the auxiliary discharge between the metal plates 2' and the scanning anodes 8 is transferred or moved toward the display side. The rear sides of the holes 13 may be covered with opaque insulating plates and on the front side of these insulating plates may be applied fluorescent materials. Moreover in the present embodiment the display anodes 4' are formed by applying transparent conductive materials in a strip form on the rear surface of the front sheet 16. The conductive strips are covered with transparent insulating film 6' except for small portions 5' opposite to the cathodes 1. The fluorescent materials are provided on the rear surface of the front sheet 16 as in the previous embodiments.

The discharge unit of the display panel of this embodiment has the same construction and arrangement as those of the first embodiment of FIG. 1 except for the above explained matters and also has the same operational functions, but the construction of the display panel of this embodiment is much simpler than the first embodiment and thus the display panel of this embodiment can be easily and cheaply manufactured.

Figure 6:
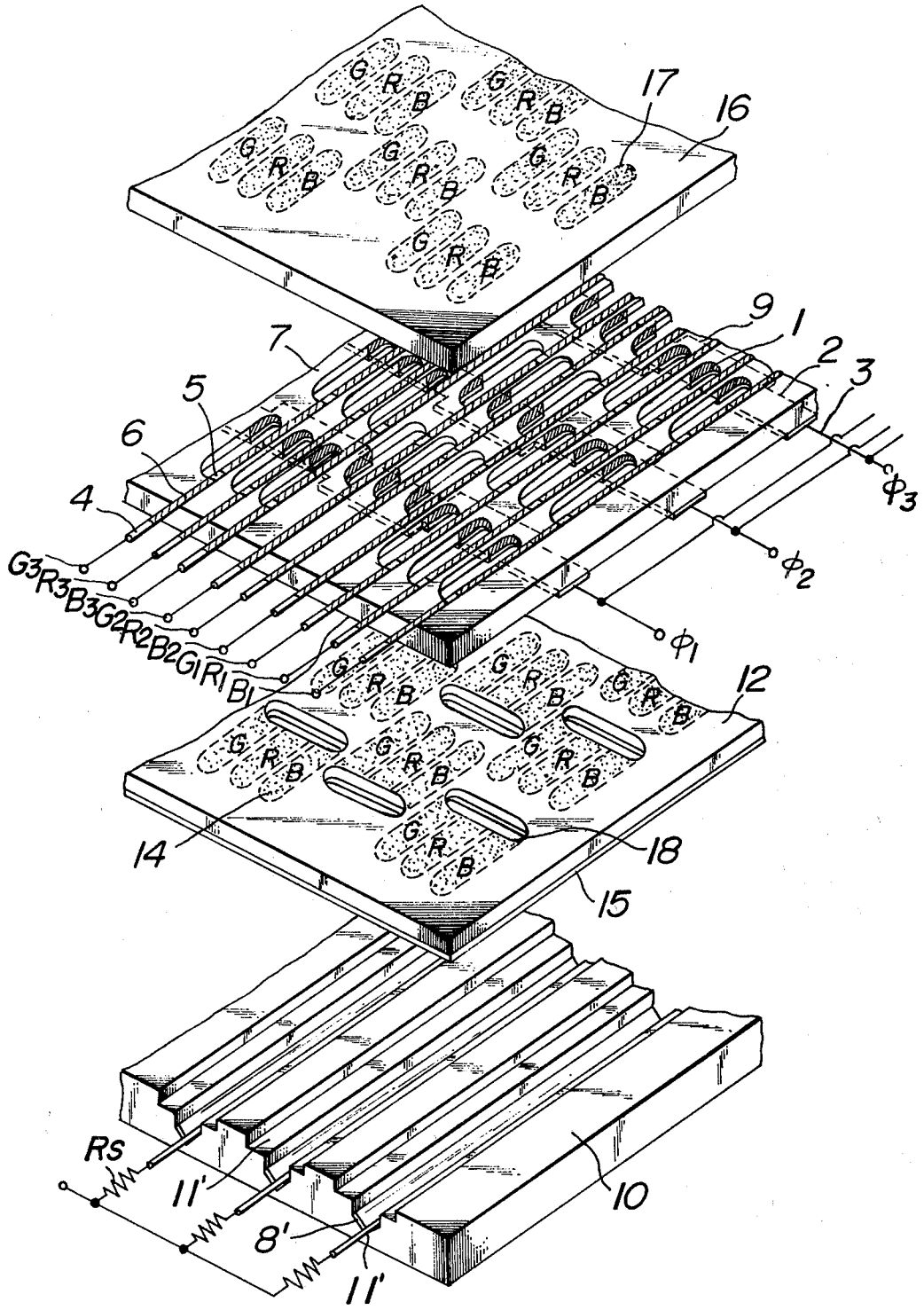
FIG. 6 is an exploded perspective view of another embodiment of the present invention.

FIG. 6 shows further embodiment of the display panel according to the invention. In this embodiment the construction and arrangement of the display sheet 7, intermediate sheet 12 and the front sheet 16 are entirely the same as those of the display panel shown in FIG. 1, but the scanning anodes 8 inserted in the troughs 11 of the rear sheet 10 are substituted for scanning hollow cathodes 8' formed by conductive strips applied on surfaces of troughs 11' having a concave cross section such as a V-shaped formed at the middle of V-shaped troughs 11' in the rear sheet 10. In the known self-scan panel display device a means for producing auxiliary discharge for scanning at the rear side of the display cathodes is formed by scanning anodes arranged opposite to the display cathodes and the glow discharge formed between the display cathodes and scanning anodes is transferred. But due to the construction, light of a negative glow formed near the cathodes might penetrate into the display side to increase the brightness at a dark portion of the displayed image, so that the discharged image might be deteriorated. Moreover a high driving voltage is required for driving the display anodes with the aid of the auxiliary discharge at the rear side of the cathodes. In order to obviate these disadvantages in the present embodiment the scanning cathodes are arranged in the above mentioned manner and the driving method is improved so as to decrease the operational voltage of the discharge units at the display side. That is to say, in the present embodiment the cathode coupling conductors 2 of the embodiment shown in FIG. 1 (which conductors are referred to as intermediate electrodes in this embodiment) are used as scanning anodes and the auxiliary discharge for scanning is formed between the intermediate electrodes and the V-shaped scanning cathodes 8', so that the negative glow at the scanning side is formed inside the V-shaped cathodes 8' and the luminescent light due to the negative glow at the scanning side is hardly seen from the display side to decrease considerably the brightness of the dark portions in the displayed image. Furthermore in the present embodiment electrons from the scanning cathodes 8' in the operating condition of the scanning side are accelerated by the scanning anodes 2 towards the display side and when a signal voltage is applied to the display anodes 4, electrons are successively accelerated in dependence on the applied signal voltage so that the low voltage operation can be achieved.

Figure 7A:
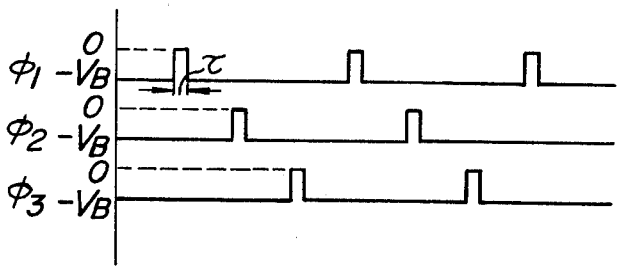
FIG. 7(*a*) illustrates waveforms of the driving voltages for the display panel of FIG. 6 and FIG. 7(*b*) shows a part of the waveforms in an extended scale for explaining the operation.
Figure 7B:
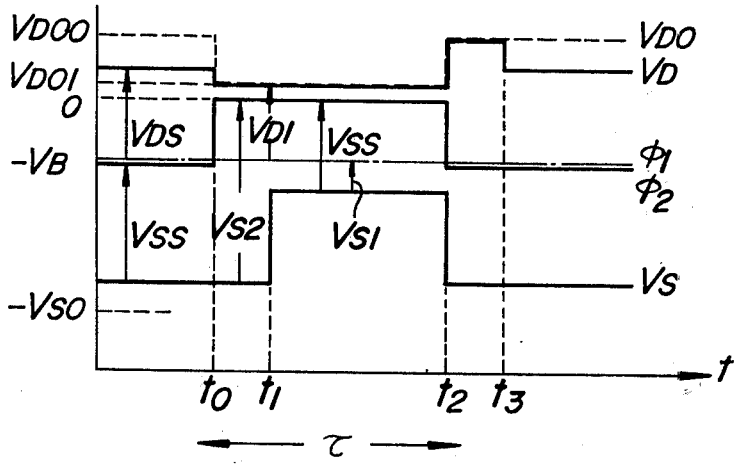

For driving the display panel according to this embodiment a d.c. voltage of, for example, negative 250 V is applied to the scanning cathodes 8' through separate stabilizing resistors Rs and pulse voltages of rectangular waveforms such as shown in FIG. 7(*a*) are applied to the scanning anode group (intermediate electrode group 2) in a phase sequence manner or in the form of travelling pulses appearing at a time interval of the scanning period to produce the auxiliary discharge having a plane scanning function. Since the relation of voltages supplied to the intermediate electrodes 2 and two other electrodes (scanning cathodes 8' and display anodes 4) is different from the other embodiments, a special driving method for self-scanning has to be applied for the intermediate electrodes 2. This operation will be explained hereinafter with reference to FIG. 7(*b*) which shows a part of the driving voltages of FIG. 7(*a*) in an enlarged scale. In FIG. 7(*b*) $\phi_1$ and $\phi_2$ represent the intermediate electrode driving voltages of first and second phases, respectively, at a transient instance from the first phase to the second phase. VD and VS illustrate waveforms of voltages applied to the display anodes 4 and scanning cathodes 8', respectively, and VDO and VSO are source voltages for the display anodes 4 and scanning cathodes 8', respectively. VDO has a value VDO1 in a period during which any one of the intermediate electrodes 2 is at zero volts and has a value VDO0 for the remaining period. The display anodes 4 and scanning cathodes 8' are connected to respective sources through respective series resistors and the intermediate electrodes 2 are directly connected to a driving circuit of low output impedance. A time instance at which the driving voltage $\phi_2$ changes from −VB to 0 is denoted as $t=t_0$ and a time period $t<t_0$ is referred to as the first phase and a time period $t>t_0$ as the second phase. During the first phase $t<t_0$, the source voltage at the scanning side of VSO+VB is applied and discharge is produced between the intermediate electrode 2 related to the driving voltage $\phi_1$ and the scanning cathode 8' and thus the voltage therebetween is at a discharge maintaining voltage VSS. The source voltage at the display side of VDO+VB is applied and discharge is produced between the display anode 4 and the intermediate electrode 2 related to the driving voltage $\phi_1$ and the voltage therebetween is held at a discharge maintaining voltage VDS. In this case the voltages VSS and VDS are applied between the intermediate electrode 2 related to the driving voltage $\phi_2$ and scanning cathode 8' and between the display anode 4 and the intermediate electrode 2 related to the driving voltage $\phi_2$, respectively, but these voltage values are lower than their respective discharge start voltages, so that the discharge does not occur in the first phase. At $t=t_0$ when the driving voltage $\phi_2$ changes to 0 volts, the voltage between the intermediate electrode 2 related to the voltage $\phi_2$ and the scanning cathode 8' increases to VSS+VB=VS2 and thus if the value VB is selected in such a manner that the voltage VS2 is higher than the discharge start voltage, discharge is produced between the intermediate electrode 2 relating to $\phi_2$ and scanning cathode 8' at the scanning side in the second phase at a time instance $t=t_1$ after a certain period has elapsed from the instance $t_0$ and the voltage at the scanning cathode 8' changes from VS to −VSS. As the result the voltage between the intermediate electrode relating to the driving voltage $\phi_1$ and the scanning cathode 8' decreases to a value VS1=VSS−VB and thus if the voltage VS1 is established to be lower than the discharge maintaining voltage VSS, the discharge at the scanning side of the first phase is stopped. In this manner the auxiliary discharge at the scanning side is transferred.

Next discharge at the display side will be explained. Since the source voltage VD1 at the display anode 4 is decreased to VDO1 at the instance $t=t_0$, the voltage applied to the discharge units at the display side of the first phase decreases to VD1=VD01+VB and thus if VD1 is determined to be lower than the discharge maintaining voltage VDS of the discharge units, discharge at the display side of the first phase is stopped at the time $t=t_0$. The voltage VDO1 applied to the discharge units of the second phase at the display side is lower than VD1 and thus discharge is not produced at these discharge units. When at a time instance $t=t_2$ the source voltage VDO for the display anode 4 and the driving voltage $\phi_2$ are returned to VDO0 and −VB, respectively, the voltage applied to the discharge units at the display side becomes VD0+VB. If this applied voltage VD0+VB is higher than a discharge start voltage in the case of auxiliary discharge being formed at the scanning side, the discharge units of the second phase is actuated at an instance $t_3$ which is a little later than $t_2$. In the manner explained above the subsequent self-scan is effected by means of the driving voltages having the waveforms shown in FIG. 7(*a*).

According to the driving method in the present embodiment there is an advantage that discharge both at the display and scanning sides can be separately controlled by means of the voltage variations at the intermediate electrodes 2. That is to say during the time period $t_0<t<t_2$ discharge at the display side can be easily produced by increasing the voltage applied to the scanning side and during the time period $t>t_2$ the voltage applied to the scanning side is decreased so that the penetration of luminous light due to the auxiliary discharge at the scanning side into the display side can be decreased so as to obtain low brightness of backgrounds of the displayed image and in addition thereto the voltage applied to the display side is increased so as to display the image with high brightness.

When the television image has to be displayed by means of the display panel of the present embodiment, the picture information signal may be supplied to the display anode group in the form of voltage or current through respective driving circuits such as modulators and electronic switching circuits. Moreover the color television image may be display in the same manner as that which has been mentioned in conjunction with FIG. 1.

Figure 8A:
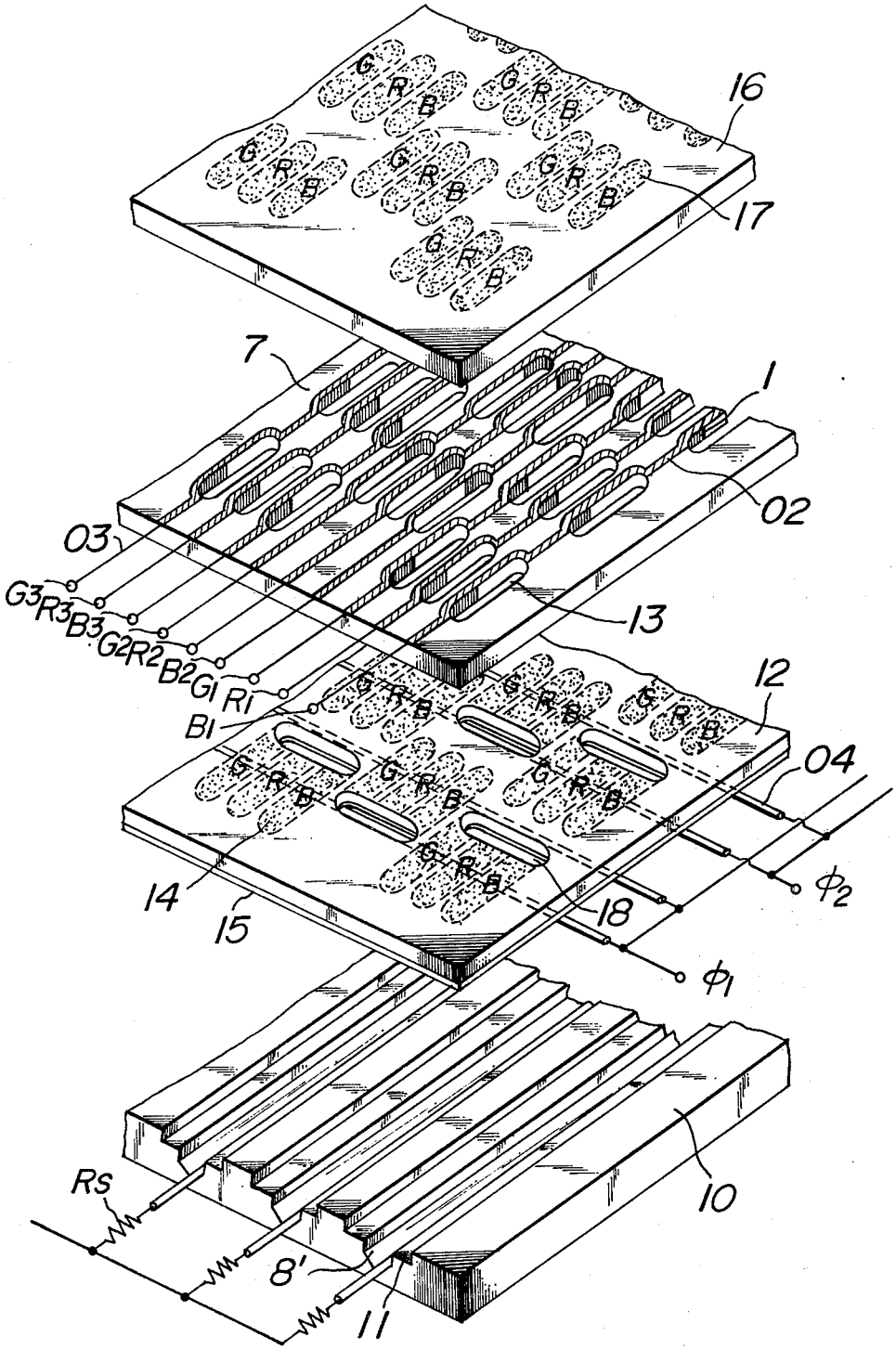
FIGS. 8(*a*), 8(*b*) and 8(*c*) are an exploded perspective view, a cross sectional view and a partial plan view, respectively, of still another embodiment of the invention.
Figure 8B:
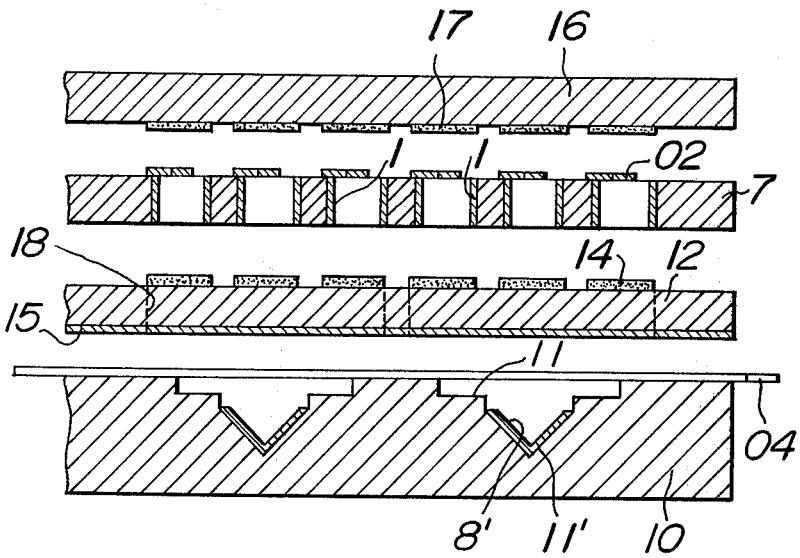
Figure 8C:
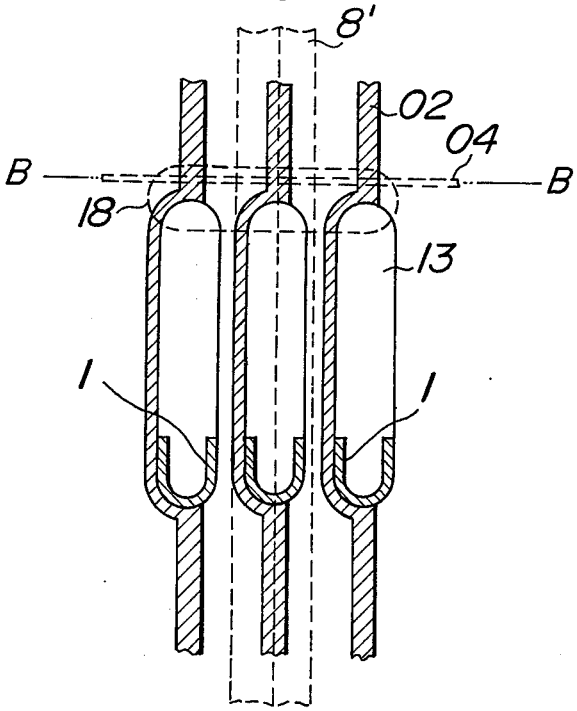

FIG. 8 illustrates another embodiment of the display panel according to the invention. In the present embodiment the picture information signal is applied to the cathodes provided in the discharge units so as to display images. Accordingly the arrangement of the electrodes differs slightly from that shown in FIG. 1. As shown in the drawings a number of elongated through holes 13 are formed in a display sheet 7 and on one end of inner surfaces of these holes are applied conductive materials to form U-shaped cathodes 1. The cathodes aligned with each other in the longitudinal direction thereof are electrically connected to each other by means of conductive strips 02 which are applied on the front surface of the display sheet 7 and extend substantially in the longitudinal direction of the holes 13. One end of the conductive strips 02 is connected to cathode lead wires 03. The conductive strips 02 are covered with insulating materials so that the U-shaped cathodes provided on the inner surfaces of the holes 13 serve as so-called hollow cathodes and more stable cathode discharge can be obtained. Anodes 04 are formed by stripshaped electrodes such as conductive wires and are arranged behind an intermediate sheet 12 at positions which are aligned with elongated holes 18 formed in the intermediate sheet 12. The anodes 04 extend in the direction normal to the cathode coupling conductive strips 02. In a similar manner as shown in FIG. 6, at the rear side V-shaped scanning cathodes 8′ are arranged in troughs 11 formed on the inner surfaces of V-shaped troughs of a rear sheet 10. Discharge produced between the wire-shaped anodes 04 and scanning cathodes 8′ is used as auxiliary discharge which is successively transferred. Further in this embodiment red, green and blue fluorescent materials are applied on the inner surface of the front sheet 16 and the front side of the intermediate sheet 12 at positions corresponding to the holes 13.

Figure 9:
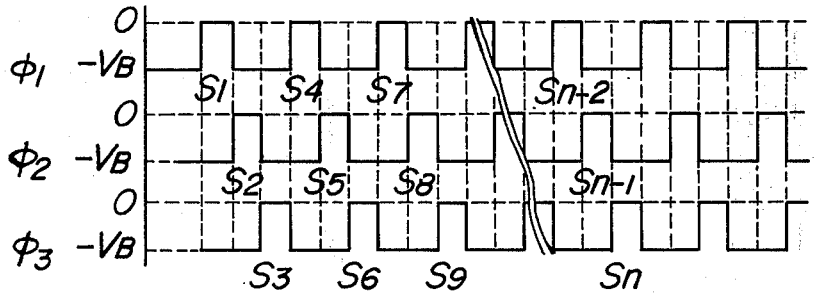
FIG. 9 illustrates waveforms of driving pulses for the display panel shown in FIG. 8.

Now the operation of the display panel of the present embodiment will be explained. Since in this embodiment the anodes are arranged at positions which were occupied by the cathodes of the embodiment of FIG. 1 and the cathodes are provided at positions at which the anodes of the embodiment of FIG. 1 were arranged, the driving signal can be obtained by inverting the polarity of the driving pulses shown in FIG. 2. The driving pulses for this embodiment are illustrated in FIG. 9 and are applied to the display anodes 04. To the scanning cathodes 8′ is applied a source voltage of, for example, −250 V through series resistors Rs and to the display cathodes 02 is applied a voltage of −250 V through driving circuits. The display panel of this embodiment can attain the self-scanning in the similar manner as the first embodiment shown in FIG. 1.

Figure 10:
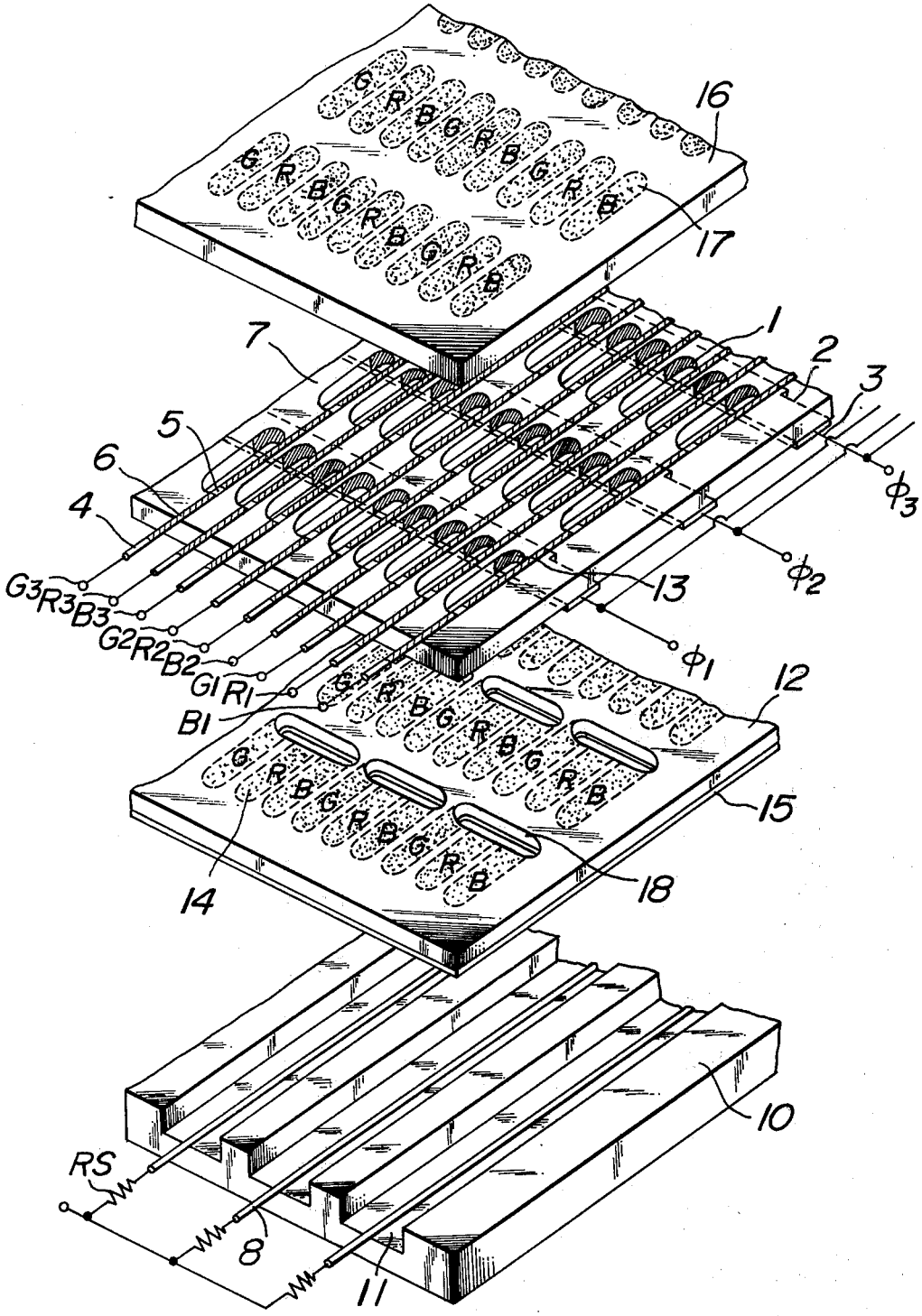
FIG. 10 is an exploded perpective view of still another embodiment of the invention.
Figure 11:
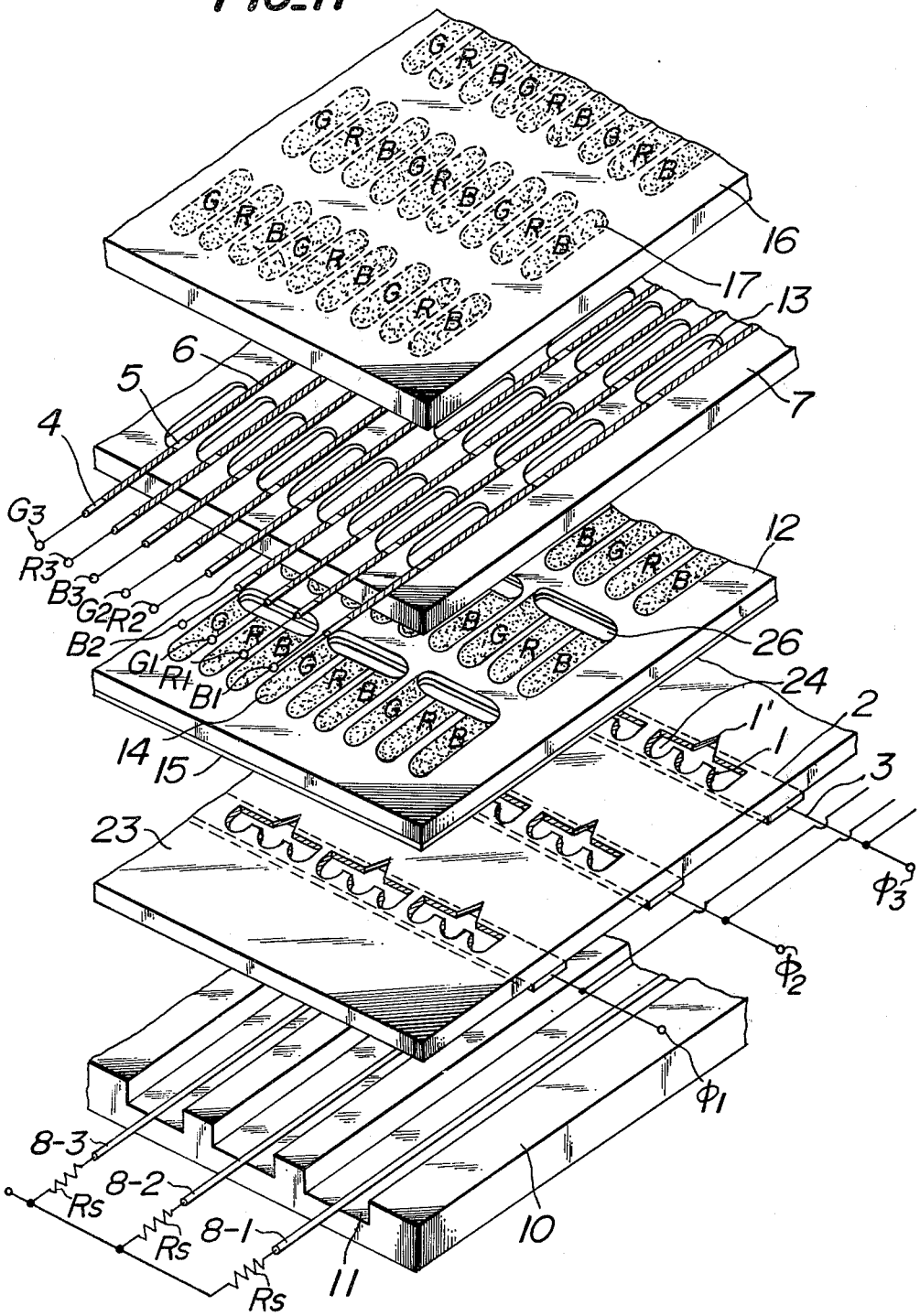
FIG. 11 is an exploded perspective view of still another embodiment of the invention.

In the embodiments explained hereinbefore the discharge units are arranged in the zigzag manner suitable for the interlace scanning. However the present invention is not limited to such a zigzag arrangement of discharge units, but they may be arranged regularly in a row and column manner. FIGS. 10 and 11 show two embodiments in which the discharge units are arranged regularly. These embodiments are substantially the same as those shown in FIGS. 1 and 3, respectively, except for the arrangement of the discharge units and thus the detailed explanation of these embodiments is omitted.

Figure 12A:
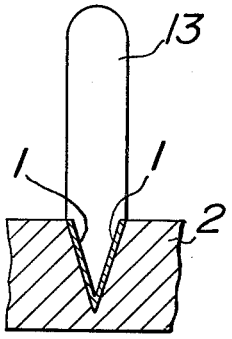
FIGS. 12(*a*), 12(*b*) and 12(*c*) are cross sectional views showing various forms of the cathodes of the discharge unit according to the invention.
Figure 12B:
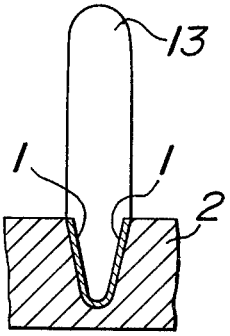
Figure 12C:
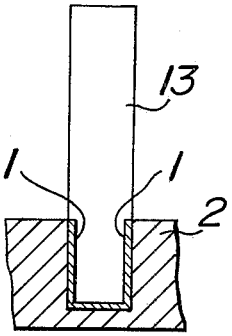
Figure 13A:
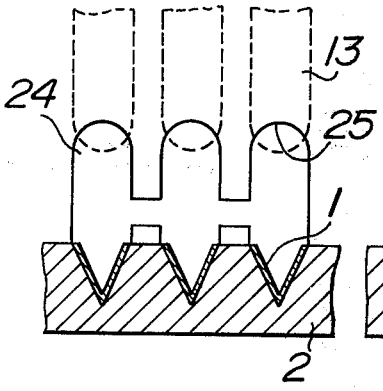
FIGS. 13(*a*) to 13(*f*) are plan views illustrating various forms of the cathodes of the gaseous discharge display panel according to the invention.
Figure 13B:
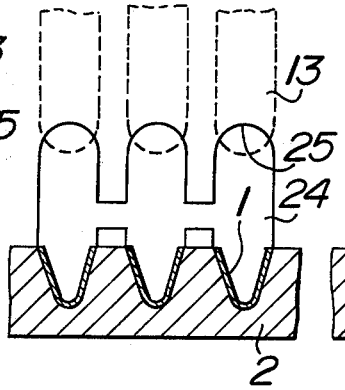
Figure 13C:
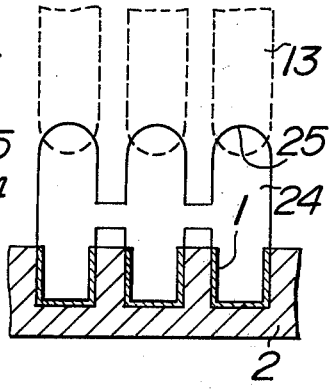
Figure 13D:
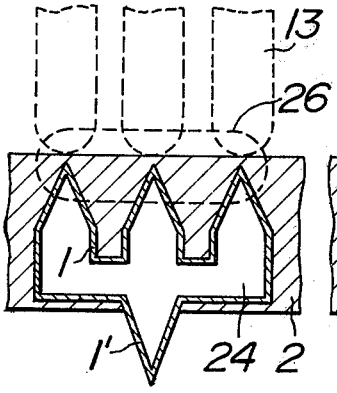
Figure 13E:
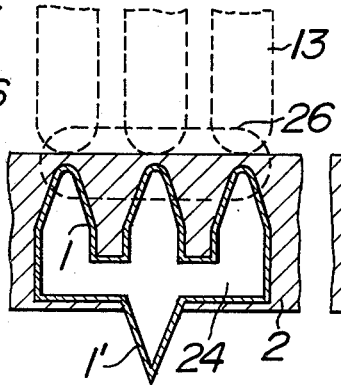
Figure 13F:
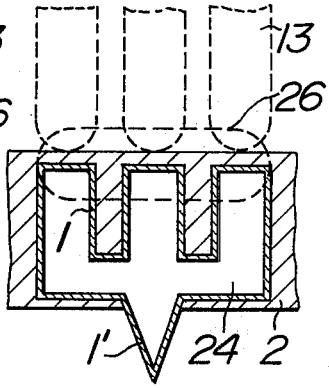

According to the invention the cathode of the discharge unit may be also formed in various shapes. FIGS. 12 and 13 illustrate several shapes of the cathodes in which one end of the elongated holes 13 in the display sheet is formed in a V, circular or rectangular shape and on the inner surfaces of these holes is applied conductive material to form the hollow cathodes of various shapes. The elongated through holes 13 in the display sheet can be accurately formed by applying photo-etching or chemical etching treatment to a thin glass plate. Conductive layers for constructing the hollow cathodes and cathode coupling conductors can be simply formed by applying conductive material on the inner surfaces of the holes and the main surface of the display sheet by means of electroplating, electroless plating or printing technics.

In the embodiments shown in FIGS. 1 and 4 the display sheet 7, intermediate sheet 12 and cathode sheet 23 are separated, but these sheets may be formed as an integral body. In this case a number of shallow elongated recesses are formed on the front surface of the insulating plate by means of etching and fluorescent materials are applied on bottom surfaces of these recesses. At one end of the elongated recesses the anodes are provided in the same manner as that previously explained. At the other end of the recesses the insulating plate is further etched away from both surfaces to form through holes, each communicating with the recesses. The cathodes may be applied on one side wall of the through holes and the cathode coupling conductors may be applied on the rear surface of the insulating plate. In this manner the display panel according to the invention can be advantageously manufactured by using an etching technique. Further in this construction shallow recesses may be formed also on the inner surface of the front sheet at positions corresponding to the recesses in the insulating plate by means of etching and fluorescent materials may be applied on the bottom walls of these shallow recesses in the front sheet.

In the gaseous discharge display panel according to the invention comprising the discharge units of elongated shape having a discharge path extending in parallel to the panel plane, the discharge units can be arranged with a high fill factor as compared with the known display panel and thus it is possible to display more detailed images. On the other hand since the distance between the anode and cathode of adjacent discharge units is shorter than the distance between the anode of the same discharge unit, mis-discharge might be produced between adjacent discharge units through spaces between laminated sheets such as between the display sheet and front sheet or intermediate sheet so that cross-talk of the picture signal for driving the discharge units will easily occur. In order to avoid such a disadvantage when the laminated sheets are hermetically sealed, not only these sheets are sealed by flit glass at their peripheries, but also the whole surfaces of these sheets are applied with flit glass and then are thermally compressed to each other except for portions constructing the discharge units. In this construction the discharge units are separated from each other and this mis-discharge between adjacent discharge units causing cross-talk in displayed images can be obviated.

Figure 14A:
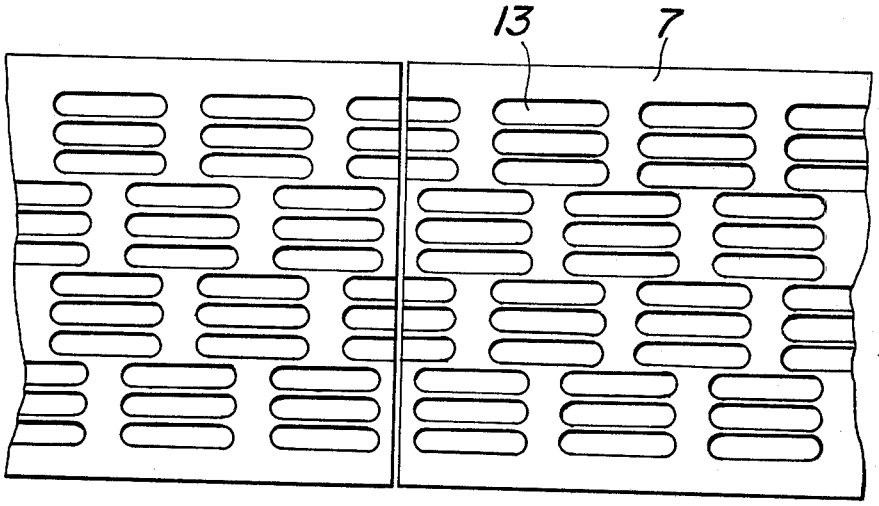
FIGS. 14*a* and 14*b* are plan views showing a large screen display panel composed of a plurality of gaseous discharge display panels according to the invention.
Figure 14B:
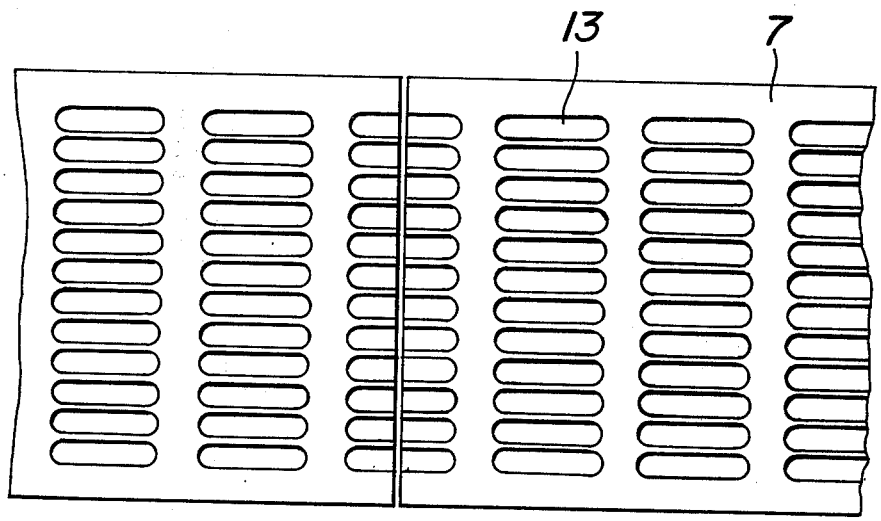

The display panel according to the invention is particularly suitable for constructing a display apparatus having a wide screen such as a television display screen which is used by being hung on a wall. For example several display sheets 7 constructing the discharge units may be connected to each other as shown in FIGS. 14 (*a*) and 14(*b*). As described above the gaseous discharge display panel according to the invention can be easily manufactured, is suitable for displaying color images of higher brightness and definition and is particularly suitable for composing a large display screen.

The most realizable method for displaying color images by using the gaseous discharge display panel is to excite fluorescent materials provided in the discharge spaces by means of ultra-violet rays which are produced by discharge. However the known gaseous discharge display panel could not display images of higher brightness mainly owing to the following reasons. 1. In the discharge unit using the flat cathode the discharge current is small. Moreover even if there could be a large discharge current, the radiation intensity of the ultraviolet rays does not increase. 2. Due to the construction of the known discharge unit the ultra-violet rays radiated from plasma of a positive column could not be utilized. 3. Due to the construction ultra-violet rays produced from discharge plasma is attenuated by absorption in the discharge space before it reaches fluorescent materials.

4. Due to the positions at which fluorescent materials are applied luminescent light from fluorescent materials is not sufficiently utilized.

5. Due to the arrangement of the cathodes materials sputtered from cathodes by means of ion bombardment are applied on fluorescent materials so as to blacken fluorescent materials. This is the main reason for decreasing brightness. Therefore an average total efficiency of the red, green and blue fluorescent materials is very low in the order of 0.1.

Figure 15:
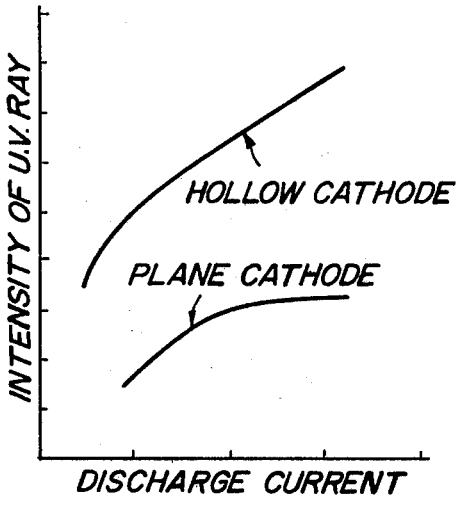
FIG. 15 is a graph for illustrating discharge current-ultra-violet radiating intensity characteristic curves of a known discharge unit having a plane cathode and the discharge unit having a hollow cathode according to the invention.

The novel gaseous discharge display panel according to the invention can overcome the disadvantages mentioned above. In order to solve the first problem (1) the cathode of the discharge unit is formed as the hollow cathode so that a larger discharge current can flow and the cathode voltage drop can be decreased so as to make less power loss at the discharge unit. Concerning the radiation intensity of ultra-violet rays in the known device, the radiation intensity becomes saturated already at a lower value of the discharge current as shown in FIG. 15. On the contrary in the discharge unit using the hollow cathode according to the invention the radiation intensity still increases even in a range of a larger discharge current. Moreover as the result of measuring actually the intensity of ultra-violet rays from negative glow plasma formed near the cathode by means of a spectrophotometer it has been found that the intensity of ultra-violet rays in the discharge unit with the hollow cathode according to the invention is larger than that in the discharge unit with the flat cathode by six or seven times.

In order to solve the above problems (2) and (3) according to the invention the discharge unit is constructed as an elongated section extending in parallel to the display plane and the discharge light is produced in parallel to the display panel. By means of such a construction fluorescent materials can be excited not only by ultra-violet rays from discharge at the cathode drop portion but also by that from the positive column plasma portion. Thus the amount of ultra-violet rays for exciting fluorescent materials according to the invention is increased and is larger by two or three times than that of the known discharge unit.

Figure 16:
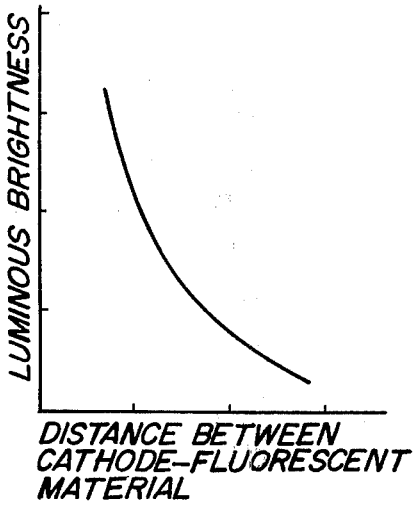
FIG. 16 is a graph for showing a luminescent brightness property with respect to a distance between the cathode and fluorescent materials in the known discharge unit having the plane cathode.

Further in the discharge unit according to the invention the negative glow plasma at the cathode portion and the positive column plasma are formed nearer to fluorescent materials, so that ultra-violet rays produced from said plasma portions for exciting fluorescent materials are not affected by the absorption in the introduced gas. The luminous brightness is increased also due to the above procedure. FIG. 16 illustrates the luminous brightness characteristics of the known discharge unit comprising the flat cathode as a function of the distance between the cathode and fluorescent materials. It is apparent from FIG. 16 that the luminous brightness is extremely decreased with increasing distance.

Further in the discharge unit according to the invention fluorescent materials can be excited also by ultra-violet rays produced from the positive column plasma. If the composition of introduced gas and dimensions of various elements constructing the discharge unit are suitably determined, it is possible to form a positive column electric field which is matched to produce ultra-violet rays. Various other methods can be adopted to increase the brightness.

In order to solve the fourth problem (4) fluorescent materials are applied at front and rear sides of the elongated through hole constructing the discharge path being aligned with said hole so that the luminescent light of fluorescent materials can be viewed in the form of reflected and transmitted light. In this manner the brightness of the displayed image can be considerably improved.

Figure 17:
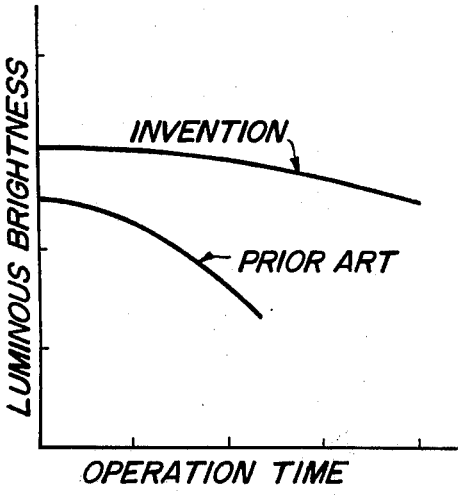
FIG. 17 is a graph for illustrating the time decay of the brightness of the fluorescent material of the known gaseous discharge display panel and that of the present invention.

The discharge unit according to the invention can also avoid the disadvantage mentioned in the above item (5). That is to say in the present discharge unit the cathode can be provided at such a position that it is hidden from fluorescent materials so that even if the cathode material is sputtered by ion bombardment, the sputtered material is prevented from reaching the fluorescent materials by means of the narrow discharge path to avoid completely a decrease of brightness due to ion bombardment. As an example FIG. 17 illusrates two time decay characteristic curves of luminous brightness of fluorescent materials provided in the discharge units of the prior art and the present invention, respectively. As shown in FIG. 17 the luminous brightness of the known discharge unit is considerably decreased after a short time period of use whereas in the discharge unit according to the invention the great improvement is obtained in the luminous brightness.

Figure 18:
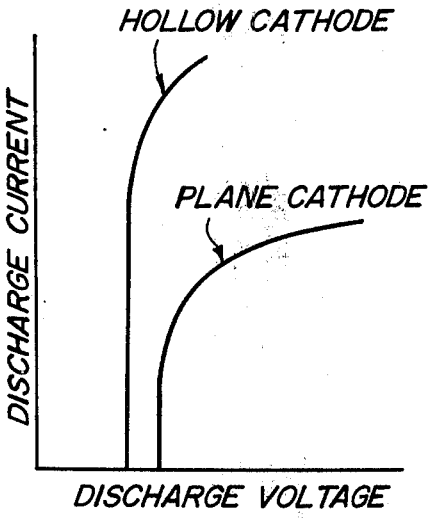
FIG. 18 is a graph showing the discharge characteristics of the known discharge units with the plane cathode and that of the present invention having the hollow cathode.

FIG. 18 shows two discharge characteristic curves of the discharge units of the prior art and the present invention, respectively. In the present invention by introducing the hollow cathode in the discharge unit there can be obtained an advantage that the operation voltage can be lowered and the available discharge current can be increased as compared with the known discharge unit. Moreover in the display panel according to the invention the substrates constructing the discharge units can be easily composed so that a panel type display apparatus with a large display screen can be manufactured in a relatively simple manner.

In the embodiments explained above the fluorescent materials are applied at the front and/or rear side of the discharge units. However the invention is not limited to such a construction. When it is sufficient to display images with monochrome, the fluorescent materials may be omitted. Even in this case it is possible to display images of high brightness, because discharge is produced in parallel to the plane of the display panel with a larger area.

What is claimed is:

1. A gaseous discharge display panel of a multi-layer construction comprising a transparent front sheet, an opaque rear sheet and an electrically insulating display sheet which is inserted between said front and rear sheets and in which a number of small through holes each constructing a discharge unit corresponding to a picture element are formed, said sheets forming a hermetically sealed envelope, and an ionizable gas contained in said envelope, said through holes being shaped in an elongated section extending along the plane of said display sheet in parallel with each other, and each of said through holes comprising an anode at one end and a cathode which is formed by a conductive material applied on an inner surface of the through hole at the other end.

2. A gaseous discharge display panel as claimed in claim 1, wherein on the inner surface of said front sheet are applied a number of films of fluorescent materials at positions corresponding to said through holes in said display sheet.

3. A gaseous discharge display panel as claimed in claim 2, wherein said cathode is formed in U-, V- or rectangular shape to operate as a hollow cathode.

4. A gaseous discharge display panel as claimed in claim 2, wherein in order to display a color image said number of discharge units and fluorescent films are divided into a number of groups each of which comprises three successive discharge units and corresponding three successive fluorescent films, these three fluorescent films radiating three primary colors for displaying the color image.

5. A gaseous discharge display panel as claimed in claim 4, wherein in order to display a color image with an interlaced scanning said groups are arranged in a zigzag manner.

6. A gaseous discharge display panel as claimed in claim 2, wherein said anode is constructed by that part of a conductive strip applied on a surface of said display sheet which is not covered with insulating materials.

7. A gaseous discharge display panel as claimed in claim 2, wherein said anode is formed by a conductive strip which is branched out of a conductive strip applied on the rear surface of said front sheet and covered with insulating materials.

8. A gaseous discharge display panel as claimed in claim 2, wherein said anode is arranged at a position which is hidden from a discharge space constituting said discharge unit.

9. A gaseous discharge display panel as claimed in claim 4, wherein an insulating or conductive opaque intermediate sheet is inserted between said display and rear sheets, said intermediate sheet having formed therein a number of through holes each constructing a common discharge path for said successive three discharge units of each group at positions corresponding to either said anodes or cathodes, and a number of fluorescent films are applied on the front surface of said intermediate sheet at positions corresponding to said through holes in said display sheet.

10. A gaseous discharge display panel as claimed in claim 9, wherein said display sheet is composed of two layers between which said intermediate sheet is inserted and said anode and cathode of the discharge unit are provided separately on said divided two layers.

11. A gaseous discharge display panel as claimed in claim 2, wherein when the width and length of said elongated through holes formed in said display sheet are denoted as d and $l$, respectively, then $d$ and $l$ satisfy a condition $3d < l < 50d$.

12. A gaseous discharge display panel as claimed in in claim 2, wherein on the inner surface of said rear sheet are formed a number of troughs in parallel with each other and in each of said troughs is inserted a scanning cathode including a conductive wire.

13. A gaseous discharge display panel as claimed in claim 2, wherein on the inner surface of said rear sheet are formed a number of troughs in parallel with each other and in each of said troughs is provided a scanning anode including a strip-shaped conductor having a concave cross section.

14. A gaseous discharge display panel as claimed in claim 4, wherein said number of groups are arranged regularly in rows and columns as a matrix form.

15. A gaseous discharge display panel as claimed in claim 4, wherein said display panel further comprises an electrically insulating cathode sheet between said display and rear sheets, said cathode sheet having formed therein a number of through holes each constructing a common discharge path for said successive three discharge units of each of said groups at positions near that end of said through holes in said display sheet which is remote from said anodes, and each of said through holes in the cathode sheet comprises a cathode including a conductive layer applied on its inner surface at a position which is not opposite to said through holes in said display sheet, said cathode sheet constructing the discharge unit together with said anode.

16. A gaseous discharge display panel as claimed in claim 15, wherein on the inner surface of said cathode sheet are applied a number of fluorescent films at positions corresponding to said through holes in said display sheet.

17. A gaseous discharge display panel as claimed in claim 15, wherein said display panel further comprises an electrically insulating opaque intermediate sheet between said display and cathode sheets, said intermediate sheet having formed therein a number of through holes at positions corresponding to said through holes in the display sheet and cathodes of the discharge units, each of said through holes in the intermediate sheet constituting a common discharge path for the successive three discharge units of each of said groups, and a number of fluorescent materials applied on the front surface of said intermediate sheet at positions corresponding to the through holes in the display sheet.

18. A gaseous discharge display panel as claimed in claim 15, wherein said through holes formed in said cathode sheet are provided with wedge-shaped projections at one side remote from said anodes and there are provided cathodes for transferring auxiliary discharge for scanning, said scanning cathodes being formed by conductive materials applied on the inner surfaces of said wedge-shaped projections.

19. A gaseous discharge display panel as claimed in claim 9, wherein said display sheet and intermediate sheet for constructing the discharge units are formed as an integral body.

20. A gaseous discharge display panel as claimed in claim 10, wherein said display sheet and intermediate sheet are formed as an integral body.

21. A gaseous discharge display panel as claimed in claim 2, wherein said sheets for constructing the discharge units are hermetically sealed to each other except for portions forming the discharge paths.

* * * * *